US011796279B1

(12) United States Patent
Vabnick et al.

(10) Patent No.: US 11,796,279 B1
(45) **Date of Patent: *Oct. 24, 2023**

(54) DISRUPTER DRIVEN HIGHLY EFFICIENT ENERGY TRANSFER FLUID JETS

(71) Applicant: The United States of America as Represented by the Secretary of the Navy, Indian Head, MD (US)

(72) Inventors: Ian B. Vabnick, Fredericksburg, VA (US); Phillip R. Quillen, Redstone Arsenal, AL (US); Eric S. Morefield, Quantico, VA (US); Arthur W. Ellis, Swan Point, MD (US); Lee Foltz, Indian Head, MD (US)

(73) Assignee: The United States of America, as represented by the secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/300,686

(22) Filed: Sep. 29, 2021

Related U.S. Application Data

(63) Continuation of application No. 15/731,874, filed on Aug. 18, 2017, now Pat. No. 11,187,487.

(51) Int. Cl.
*F42B 33/06* (2006.01)
*F41B 9/00* (2006.01)

(52) U.S. Cl.
CPC ..... *F41B 9/0046* (2013.01); *F42B 33/062* (2013.01)

(58) Field of Classification Search
CPC ..... F42B 33/062; F41B 9/0046
See application file for complete search history.

(56) References Cited

U.S. PATENT DOCUMENTS 4,164,904 A * 8/1979 Laviolette ..... F42B 10/34 102/529
4,955,939 A * 9/1990 Petrousky ..... F42B 12/10 102/306
4,957,027 A * 9/1990 Cherry ..... F41B 9/0046 89/1.14
5,450,795 A * 9/1995 Adelman ..... F42B 12/50 102/444
5,549,837 A * 8/1996 Ginder ..... H01F 1/447 252/62.55

(Continued)

FOREIGN PATENT DOCUMENTS

FR 2726355 A1 * 5/1996 ..... F41B 9/0046
FR 2800867 A1 * 5/2001 ..... F41B 9/0043

*Primary Examiner* — Derrick R Morgan
(74) *Attorney, Agent, or Firm* — Fredric J. Zimmerman

(57) ABSTRACT

Provided herein are projectiles for use in a propellant driven disrupter device, and associated methods, to neutralize an explosive target. The projectile may comprise a friction reducing container at least partially filled with one or more fluids, fluid mixtures, particles, and other components to provide one or more desired fluid properties to achieve a desired one or more jet parameters upon target impact. The fluid(s) in the container are referred to as highly efficient energy transfer (HEET) fluids do to the improved fluid jet action on target compared to conventional water projectiles. The projectiles and disruptor can be more precisely individually tailored to the target, thereby increasing the likelihood of successful disablement and decreasing the likelihood of inadvertent and uncontrolled explosion.

17 Claims, 17 Drawing Sheets

(56) References Cited

U.S. PATENT DOCUMENTS 6,269,725 B1 8/2001 Cherry
6,272,996 B1 * 8/2001 O'Brien ..... C06C 5/06 102/275.1
6,553,913 B1 * 4/2003 Wardlaw ..... F42B 12/74 102/501
6,896,204 B1 * 5/2005 Greene ..... F41B 9/0087 239/289
7,481,146 B2 1/2009 Weiss
7,947,937 B1 * 5/2011 Langner ..... F42B 12/42 102/501
8,196,513 B1 6/2012 O'Rourke
8,220,396 B2 * 7/2012 Ritt ..... F42B 12/76 102/502
8,677,902 B1 * 3/2014 Rock ..... F41B 9/0046 89/1.13
8,839,704 B2 9/2014 Baum
8,915,004 B1 * 12/2014 Langner ..... F42B 12/02 42/69.01
9,322,625 B1 * 4/2016 Langner ..... F41B 9/0046
9,404,718 B1 * 8/2016 Shaver ..... F41A 3/04
9,453,713 B1 * 9/2016 Langner ..... F42B 33/001
9,588,011 B1 * 3/2017 Shen ..... G01M 10/00
9,976,838 B1 * 5/2018 Langner ..... F41B 9/0046
10,054,388 B1 * 8/2018 Langner ..... F41B 9/0046
10,620,099 B2 * 4/2020 Bressan ..... F42B 12/745
11,187,487 B1 * 11/2021 Vabnick ..... F42B 33/062
2002/0096079 A1 7/2002 Alford
2004/0107826 A1 * 6/2004 Simmons ..... F41A 1/02 89/8
2006/0254452 A1 * 11/2006 Hunn ..... B26F 3/004 102/481
2007/0079721 A1 * 4/2007 Webb ..... F42D 5/04 102/512
2009/0178548 A1 * 7/2009 Tyas ..... F42B 33/062 86/50
2020/0025508 A1 * 1/2020 Vabnick ..... F41B 9/0087
2021/0041205 A1 * 2/2021 Vabnick ..... F42B 12/745
2021/0389107 A1 * 12/2021 Vabnick ..... F42B 12/745

* cited by examiner

DISRUPTER DRIVEN HIGHLY EFFICIENT ENERGY TRANSFER FLUID JETS

CROSS-REFERENCE TO RELATED APPLICATIONS

This application is a continuation of prior application Ser. No. 15/731,874, filed Aug. 18, 2017.

STATEMENT REGARDING FEDERALLY SPONSORED RESEARCH OR DEVELOPMENT

The inventions described herein were invented by employees of the United States Government and thus, may be manufactured and used by or for the U.S. Government for governmental purposes without the payment of royalties.

BACKGROUND OF INVENTION

In the art of hazardous devices access and disablement, including explosive ordnance disposal, a common tool, particularly for neutralizing improvised explosive devices (IEDs), is the propellant driven disrupter. A widely used propellant driven disrupter is the Percussion Actuated Non-Electric (PAN) disrupter. The high grade steel 24" barreled 12 gauge PAN disrupter can hold a 140 mL water projectile, for example. Water projectiles are preferred for general disruption of explosive devices and propellant-driven disrupters have been referred to as "water cannons." Disrupters can fire a jet of water to defeat IEDs. The high mass water jets work on IEDs for a longer duration than solid slug projectiles. A considerable amount of the water's momentum and energy is transferred to the bomb. Water can penetrate many kinds of light and medium cased IEDs. The water jet has a relatively large cross sectional area in comparison to a solid projectile and can tear apart a fuzing system inside an IED and separate the firing train, without requiring precise aiming at specific components. In addition, due to the water's low density jet, it produces low impact pressures. The result is a reduced probability of explosives shock initiation inside an IED. Latent heat is also minimized as the temperature of the projectile remains approximately constant.

A disadvantage of water jets, however, is that they break up quickly into a cloud of water droplets through various fluid dynamic stresses. The breaking up of the water jet can lead to the degradation of a number of important projectile parameters, including, but not limited to, jet impact duration, penetration depth, volumetric destruction, and the distance from the target at which the jet may be fired (stand-off distance). Accordingly, water as the fluid propellant in the propellant driven disrupter may not be effective or consistently reliable for certain explosive devices where any one or more of these projectile parameters are important. There are is a need in the art for fluids that address the issue of the degradation of projectile parameters, such as those listed above, associated with conventional water jets to ensure a reliable platform for neutralizing a wide range of IEDs, over a wide range of situations, including various device and environmental conditions. Provided herein are specially designed fluids, fluid components, fluid containers, firing systems, and related methods that address these various adverse issues associated with a water driven disrupter.

SUMMARY OF THE INVENTION

The devices, systems and related methods provided herein address the problems associated with water jets used in propellant driven disrupters to neutralize an explosive target, including an IED. In particular, the problems associated with water jet degradation are addressed herein by selecting special fluid compositions that are loaded into the barrel of a disruptor. The fluids are specifically selected based on their rheological properties that ensure a desired fluid jet with corresponding fluid jet characteristics or parameters strike a target. The ability to precisely vary fluid compositions and corresponding rheological properties, provides the ability to tailor the disruptor and fluid projectile to the target, thereby increasing the likelihood of successful disarmament/disablement and decreasing the likelihood of inadvertent and uncontrolled explosion. This can be achieved at little or no inconvenience to the user, such as a bomb technician. In fact, the projectiles provided herein may be prebuilt, with the desired projectile selected, and loaded into a barrel of a disrupter in a more efficient manner that has an increased likelihood of success while at least maintaining and even increasing safety, including by reducing time on target.

Provided herein are projectiles for use in a propellant driven disrupter. The projectile may comprise a friction reducing container having a cylindrical shape with a container wall having a thickness defined by an outer diameter and an inner diameter, wherein the outer diameter is selected to fit in a barrel of the disrupter and the inner diameter is selected to provide a container lumen. The friction reducing container is especially relevant for aspects where the fluid contained in the container lumen may have a tendency to interact with the disrupter barrel or plug the barrel with risk of misfire and damage to the disrupter. In this manner, the friction reducing container may help provide desired fluid jet characteristics for a desired target configuration, placement, and environmental conditions.

The friction reducing container has a proximal end that defines a proximal end of the container lumen and is configured to face a breech-end portion of the barrel, where an explosive cartridge is located. The friction reducing container has a friction reducing container distal end that defines a distal end of the container lumen and is configured to face a muzzle of the barrel. A fluid, such as a highly efficient energy transfer (HEET) fluid is positioned in the container lumen and at least partially fills the container lumen. The entire container lumen may be filled with HEET fluid. The projectiles provided herein, however, are compatible with some air pockets in the container lumen, such as a HEET fluid that fills at least 95%, 99% or 99.5% of the container lumen, including in a manner such that air pockets are not visible to the naked eye. Such large volume fraction filling may be achieved by filling the container lumen fill and placing a cap with a pin-hole over an open end of the container, such that air can escape and a little fluid can escape, and then sealing the pin hole.

Any of the projectiles may be further described in terms of the HEET fluid. For example, the HEET fluid may comprise a plurality of solid particles; wherein the plurality of solid particles are positioned at the proximal end of the friction reducing container to form a HEET density gradient, with a highest effective density at the proximal end to provide an improved jet parameter during use.

Any of the HEET fluids may comprise a Newtonian fluid, a semi-solid, or a Newtonian fluid and a semi-solid.

The HEET fluid may be selected from the group consisting of: water, oil, syrup, ionic solutions, alcohol, a liquid polymer, a pre-polymer, an elastomer-containing liquid, a mechanophore, a clay, and any combination thereof.

The HEET fluid may further comprise solid particles, such as solid particles immersed in any of the fluids described herein, including water, oil, syrup, ionic solutions, alcohol, a liquid polymer, a pre-polymer, an elastomer-containing liquid, and a clay.

Any of the projectiles provided herein may have solid particles substantially uniformly distributed in the HEET fluid, such as distributed that appears to the naked eye as uniform, or that has a local maximum or minimum particle concentration that is no more than 20% different from the average particle concentration.

Any of the projectiles provided herein may have solid particles that are not uniformly distributed, instead that are localized in a fluid zone of the container lumen, wherein the fluid zone has a length less than a length of the HEET fluid confined in the container lumen.

The solid particles may be selected from the group consisting of clay, steel shot, lead shot, plastic beads, sand, metallic microparticles, garnet (e.g., microparticles of garnet), ceramic powder, wood dust, plastic dust, and any combination thereof.

Any of the projectiles described herein may have a HEET fluid that comprises a syrup and sand mixture.

Any of the projectiles described herein may have a container lumen that comprises a plurality of fluid zones and the HEET fluid comprises a plurality of unique HEET fluid compositions, with a unique HEET fluid composition contained in each fluid zone. In this manner, for example, a proximal fluid may be positioned at the proximal end of the container lumen, a distal fluid positioned at the distal end, and none to any number of intervening fluids between the distal and proximal fluids. The fluids may be independently selected in composition. The fluids may be similar or equivalent, but with particles positioned in one or more of the fluids, including different particles and/or different particle concentration.

Any of the projectiles may comprise a membrane that separates the adjacent fluid zones, wherein the membrane prevents migration of HEET fluid or a constituent thereof between adjacent fluid zones. For example, the membrane may only prevent movement of particles between adjacent fluid zones, or the membrane may also prevent fluid migration and particle migration.

Any of the projectiles may comprise a proximal HEET fluid having a highest effective density or effective viscosity positioned in a proximal fluid zone and a distal HEET fluid having a comparatively lower effective density or viscosity positioned in a distal fluid zone. In this manner, upon HEET fluid ejection from the barrel, the reverse fluid velocity gradient may be minimized, thereby improving fluid jet parameters or tailoring those parameters to the application on hand.

Any of the projectiles may have a proximal HEET fluid that comprises solid particles suspended or dispersed in a fluid. For example, the distal HEET fluid may comprise water, syrup, liquid polymer, pre-polymer, elastomer-containing liquid, alcohol, oil, ionic solution, mechanophore, clay(s) or any combination thereof, including without suspended solid particles; and the proximal HEET fluid may comprise a fluid having a higher effective viscosity and/or effective density, than water and the solid particles are selected from the group consisting of clay, steel shot, lead shot, plastic beads, sand, metallic microparticles, garnet (e.g., microparticles of garnet), ceramic powder, wood dust, plastic dust, and any combination thereof.

Any of the projectiles may have a HEET fluid having one or more fluid (rheological) properties selected so as to achieve a desired functional parameter, such as one or more of: increase jet length at impact; increase jet impact duration; decrease jet reverse velocity gradient; decrease atomization; increase a target penetration depth; increase a momentum and energy transfer to a target; increase a volumetric destruction of a target; increase stand-off distance while maintaining target inactivation; or any combination thereof. The fluid property may be selected from the group consisting of effective viscosity, effective density, surface tension, presence of solid particles, average size of solid particles, and any combination thereof, including gradients thereof over the length of the projectile HEET fluid.

The HEET fluid may have an effective viscosity selected from the range of 1 cP to 100,000 cP at 20° C. The HEET fluid may have an effective density selected from the range of 0.5 g/mL to 15 g/mL at 20° C. The HEET fluid may have a surface tension selected from the range of 70 mN/m to 510 mN/m at 20° C.

When the HEET fluid is propelled in the barrel, it may be characterized by a Reynolds number (Re) in the barrel that is greater than 75 and less than or equal to 4000, where Re is the ratio of inertial to viscous forces, and is calculated as $Re=\rho VD/\mu$, where $\rho$ is fluid density, V is fluid velocity, D is barrel lumen diameter, and $\mu$ is fluid viscosity.

The HEET fluid may have a freezing point that is less than or equal to −20° C., thereby ensuring use even in colder conditions where water would otherwise freeze.

Any of the projectiles provided herein may be further describe with respect to the friction reducing container, also referred herein as "container". For example, the container may comprise a material selected from the group consisting of a polymer, plastic, paper, wax, a polytetrafluoroethylene such as Teflon®, and any combination thereof.

The container may comprise a plastic having a friction reducing coating covering at least a portion of an outer facing container surface, the friction reducing coating selected from the group consisting of paper, wax, a polytetrafluoroethylene such as Teflon®, a liquid lubricant, a solid lubricant, or any combination thereof.

The projectile may have a longitudinal length that spans at least 10% of a barrel longitudinal length in which the projectile is configured to be placed during use.

The friction reducing container proximal end may be configured to directly abut an explosive cartridge. In this manner, projectile loading may be efficient and reliable, without any need for inserting a plug between the projectile and the explosive cartridge.

The top or the bottom of the container lumen may be capped. For embodiments where both ends of the container lumen are originally open, both top and bottom may be capped. The cap may have a vent hole, wherein after capping the vent hole is sealed. This can help facilitate more complete container lumen filling with a HEET fluid.

Any of the projectiles provided herein may further comprise an explosive cartridge connected to the proximal end of the friction-reducing container. In this manner, even greater efficiency and reduced time on target may be achieved, with just a single device corresponding to friction reducing container and explosive cartridge, loaded into the disrupter. Furthermore, this embodiment further avoids risk of inadvertently loading the projectile in the incorrect orientation.

The projectile may further comprise a connector, having a distal end and a proximal end, wherein the distal end of the connector is connected to the proximal end of the friction reducing container, and the proximal end of the connector is connected to the explosive cartridge. The connector may have a connector length selected to achieve a user-selected propelled HEET fluid velocity. The connector may comprise a hollow tube. The distal end of the connector may comprise a distal adhesive layer to bond the distal end of the connector to the proximal end of the friction reducing container, and the proximal end of the container may comprise a proximal adhesive layer to bond the proximal end of the connector to the explosive cartridge.

Any of the projectiles may be further described in terms of measurable parameters. For example, the projectile during use may have a penetration depth that is at least 1.2 times greater than a penetration depth of a conventional water jet propelled from an otherwise equivalent propellant driven disrupter.

The projectile during use with the propellant driven disrupter may have an effective stand-off distance that is at least two times greater than a stand-off distance of an otherwise equivalent disrupter having water propellant poured into the barrel. "Effective stand-off distance" refers to the maximum distance from the disrupter barrel to the target beyond which the fluid-jet can no longer reliably prevent unwanted detonation or beyond which the result is insufficient momentum and energy transfer to the target IED.

The HEET fluid may be pre-filled in the container lumen to provide a field-ready propellant having a storage lifetime of at least 6 months. A manufacturer may make and ship the projectile to a user. Alternatively, instructions may be provided to a user and the user can pre-make any of the fluid projectiles described herein offsite for efficient use during an IED destruction event. Alternatively, the projectile may be made in the field, thereby achieving specifically tailored and designed projectile to the specific target IED. This substantially equivalent in time making of the projectile is referred herein as "on-site" manufactured. In contrast, the pre-made projectiles that are brought to the field may be referred as "off-site" manufactured.

Also provided herein are methods of making and/or using any of the projectiles described herein. For example, a method of making a projectile for use in a propellant driven disrupter may comprise the steps of: providing a friction-reducing container shaped to fit within a barrel of the propellant driven disrupter; filling the container with a HEET fluid; and sealing the friction reducing container containing the HEET fluid, thereby making the projectile for use in the propellant driven disrupter.

The method may further comprise the step of: selecting a HEET fluid based on one or more fluid parameters to achieve one or more target disruption parameters. In this manner, the projectile may be tailor-made to any of a variety of IEDs and situational variation of the IED, including position, placement, location, and surrounding environment. The fluid parameters may be selected from the group consisting of: effective viscosity; effective density; surface tension; presence or absence of solid particles in the HEET fluid; average size of the solid particles in the HEET fluid; Reynolds number of propelled HEET fluid in a barrel of the propellant driven disrupter; density gradient; viscosity gradient; fluid mass or volume; number of unique HEET fluids positioned in the container lumen; and any combination thereof. The target disruption parameters may be selected from the group consisting of: fluid jet duration; fluid jet velocity; fluid jet length at impact; momentum and energy transfer to target; shock pressure on target; volumetric disruption; penetration depth; and any combination thereof.

The method is compatible with any of a range of fluids, including multiple fluids specially arranged in the container lumen of the projectile. For example, any of the methods may further comprise the step of: filling a proximal end of the container with a proximal fluid; and filling a distal end of the container with a distal fluid. The proximal fluid and distal fluid may have at least one fluid property that is different from each other, such as fluid property selected from the group consisting of effective density, effective viscosity, a fluid composition type, presence of particulates in the fluid, and any combination thereof. In an aspect, the selection of different fluid property is to reduce a reverse velocity gradient of a jet exiting the barrel after expulsion to increase fluid jet integrity.

Any of the projectiles and related methods is compatible with a "train" of projectiles in a disrupter barrel. In this manner, the first projectile may be configured to ensure on target-aim and/or access to the internal volume of the target, with subsequent projectiles ejected from the barrel muzzle designed for disruption of internal components of the target. Accordingly, there may be a first projectile, with the method further comprising: providing a second friction-reducing container shaped to fit within the barrel of the propellant driven disrupter; filling the second container with a second HEET fluid; and capping a top end of the second container, thereby making a second projectile for use in the propellant driven disrupter; wherein the first and second projectiles are configured to insert in the barrel in an adjacent configuration.

The method is compatible with a second HEET fluid that is equivalent to the HEET fluid in the first projectile.

Also provided herein are methods of preparing a propellant driven disrupter, the method comprising the steps of: loading an explosive cartridge in a breech of the propellant driven disrupter; and filling a barrel of the propellant driven disrupter with a fluid or with a projectile cartridge containing the fluid, wherein the fluid or proximal end of the projectile cartridge is in direct physical contact with the explosive cartridge. Unlike conventional disrupters, the methods provided herein need not have a separate plug that physically separates the fluid from the explosive cartridge.

For example, the fluid may be filled directly into the barrel and no barrier is located between the fluid and the explosive cartridge. The fluid may be water, a fluid having a higher viscosity than water, or a composite fluid having solid particles in the fluid.

Any of the projectiles described herein may be made by any of the methods described herein. Similarly, any of the methods described herein may use any of the projectiles described herein.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIG. 1A top and bottom panels are cross-sectional side and top-view (respectively) of a projectile for use in a propellant driven disrupter, including a projectile containing a highly efficient energy transfer (HEET) fluid.

FIG. 6A shows each fluid as it is initially propelled out of the barrel of the propellant driven disrupter, with. FIGS. 6B-6D at increasing elapsed times since firing the respective projectile, with FIG. 6D at the moment of impact for each fluid jet.

FIG. 12, panel B, illustrates deformation that may occur in a HEET fluid projectile arising from moisture loss when the container pores are not sealed.

DETAILED DESCRIPTION OF THE INVENTION

Figure 1A:
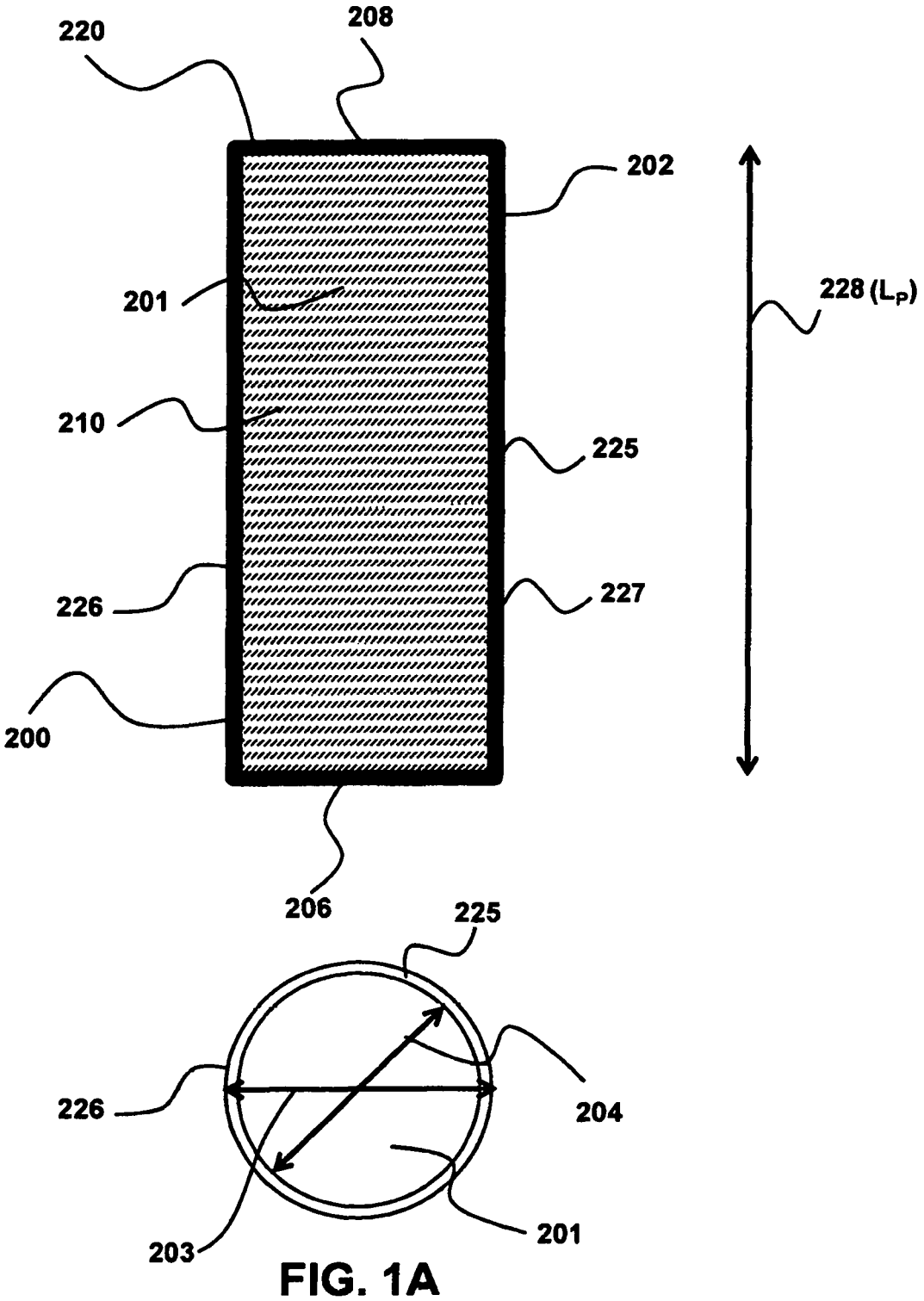

In general, the terms and phrases used herein have their art-recognized meaning, which can be found by reference to standard texts, journal references and contexts known to those skilled in the art. The following definitions are provided to clarify their specific use in the context of the invention.

The term "friction reducing container" refers to a vessel capable of containing a HEET fluid and that can be inserted into the barrel of a propellant driven disrupter to physically separate the HEET fluid from the barrel wall that defines the barrel lumen. The friction reducing container may be a liner, such as a plastic wrap, that ensures the fluid does not stick to the barrel wall that defines the barrel lumen. When in the form of a barrel liner, after preparation of the projectile, the friction reducing container serves to substantially minimize or prevent physical contact between projectile fluid (e.g., HEET fluid) and the barrel. As a barrel liner, the friction reducing container may allow fluid to be in contact with an explosive cartridge, positioned within the barrel, while preventing contact between the fluid and the inner surface of the barrel. Minimizing or preventing contact between the fluid, particularly HEET fluid, and the inner surface of the barrel is advantageous to reducing abrasion damage to the inner surface of the barrel caused by the fluid when it is propelled. When in the form of a vessel, the friction reducing container contains the fluid (e.g., HEET fluid) within itself such that the fluid does not contact the barrel and optionally the fluid does not contact the explosive cartridge. The vessel may be a hollow cylinder, having an internal lumen, that is closed on one or both ends after preparation of the projectile. An advantage of the friction reducing container in the form of a vessel that is closed on both ends is that projectile may be premade and ready for rapid use in the field. The liner, in contrast, may require additional care with respect to ensuring reliable coverage of the barrel lumen walls. The friction reducing container, in any embodiment, may be formed of paper, wax, polymer (e.g., polytetrafluoroethylene), a plastic such as a relatively rigid plastic to provide good storage lifetime, or any combination of thereof.

The term "breech" refers to the portion of the barrel of the propellant driven disrupter in which an explosive cartridge is positioned.

"Distal" refers to a direction that is furthest from the breech or the explosive cartridge, or that is closest to the to-be-disrupted target. "Proximal" refers to a direction that is toward the explosive cartridge or that is furthest from the to-be-disrupted target.

The term "effective" with regard to a fluid property such as viscosity, density, surface tension refers to an average measure of a property, including for a composite material that is formed of a combination of different materials. For example, a fluid mixture having multiple fluids and/or solid particles can be characterized as having an effective density or viscosity, which is a weighted average or bulk measure of the density or viscosity of the constituents of the fluid mixture. When applied to a fluid property, the term "effective" may refer to a mass-weighted average of the fluid and its constituents. When applied to a fluid property, the term "effective" may refer to a volume-weighted average of the fluid and its constituents. When applied to a fluid property, the term "effective" may refer to a bulk property of the fluid and its constituents.

The term "semi-solid" or "semisolid" refers to a material having properties typical of solids as well as properties typical of liquids. A semi-solid may be an amorphous, highly-viscous material. Examples of a semi-solid include, but are not limited to, petroleum jelly, mayonnaise, and paint. For example, semi-solids may retain shape like a solid on a short time scale but flow like a fluid on longer time scales. Semi-solids may exhibit more solid-like or more-liquid like properties according to conditions such as temperature, applied force, or applied impulse, for example. Semi-solids may include solid particles suspended such that the solid particles remain in a fixed location within the HEET fluid. In such mixtures of semi-solids including solid particles, migration of the solid particles, such as lead or tungsten, may be substantially prevented (e.g., no observable migration to naked eye) during the time duration of storage of the HEET fluid projectile. Semi-solids permit making complex density distributions and density gradients; in low viscosity fluids this may be impossible. Semi-solids behave like a solid under static conditions, but under dynamic conditions they behave more like a fluid. Dynamic conditions are those which produce high pressures on the semi-solid which occur for example on impact with an object. Semi-solids are viscid and as such the tip of a projectile communicates through the body of the projectile via pressure waves. When semi-solids are used in a projectile they have velocities ranging from 500 fps-2000 fps, for example. On impact, the pressures are extremely high and so the semi-solid may readily flow and behave hydrodynamically. As a fluid jet containing a velocity gradient in free flight, semi-solids tend to pile up forming a slug or flat mushroom shaped fluid jet. In contrast, low viscosity fluids such as water tend to disperse and atomize when used as a fluid jet containing a velocity gradient.

The term "pre-polymer" refers to a fluid including unpolymerized monomer molecules, capable of polymerization. "Polymer" refers to a macromolecule composed of repeating structural units connected by covalent chemical bonds or the polymerization product of one or more monomers, often characterized by a high molecular weight. The term polymer includes homopolymers, or polymers consisting essentially of a single repeating monomer subunit. The term polymer also includes copolymers, or polymers consisting essentially of two or more monomer subunits, such as random, block, alternating, segmented, grafted, tapered and other copolymers. Useful polymers include organic polymers or inorganic polymers that may be in amorphous, semi-amorphous, crystalline or partially crystalline states. Crosslinked polymers having linked monomer chains are particularly useful for some applications. Polymers useable in the methods, devices and components disclosed include, but are not limited to, plastics, elastomers, thermoplastic elastomers, elastoplastics, thermoplastics and acrylates. Exemplary polymers include, but are not limited to, acetal polymers, biodegradable polymers, cellulosic polymers, fluoropolymers (e.g., polytetrafluoroethylene), nylons, polyacrylonitrile polymers, polyamide-imide polymers, polyimides, polyarylates, polybenzimidazole, polybutylene, polycarbonate, polyesters, polyetherimide, polyethylene, polyethylene copolymers and modified polyethylenes, polyketones, poly(methyl methacrylate), polymethylpentene, polyphenylene oxides and polyphenylene sulfides, polyphthalamide, polypropylene, polyurethanes, styrenic resins, sulfone-based resins, vinyl-based resins, rubber (including natural rubber, styrene-butadiene, polybutadiene, neoprene, ethylene-propylene, butyl, nitrile, silicones), acrylic, nylon, polycarbonate, polyester, polyethylene, polypropylene, polystyrene, polyvinyl chloride, polyolefin or any combinations of these. One example useful feature of using polymer(s) in a HEET fluid is that it can allow the HEET fluid to withstand hoop stress as compared to water as a fluid jet. This physiochemical characteristic helps to keep jetting material from a disrupter together as the fluid jet experiences a pressure gradient while being unconfined outside of a barrel.

The term "elastomer-containing liquid" refers to a liquid or liquid mixture including elastomer molecules. "Elastomer" refers to a polymeric material which can be stretched or deformed and returned to its original shape without substantial permanent deformation. Elastomers commonly undergo substantially elastic deformations. Useful elastomers include those comprising polymers, copolymers, composite materials or mixtures of polymers and copolymers. Elastomeric layer refers to a layer comprising at least one elastomer. Elastomeric layers may also include dopants and other non-elastomeric materials. Useful elastomers include, but are not limited to, thermoplastic elastomers, styrenic materials, olefinic materials, polyolefin, polyurethane thermoplastic elastomers, polyamides, synthetic rubbers, PDMS, polybutadiene, polyisobutylene, poly(styrene-butadiene-styrene), polyurethanes, polychloroprene and silicones. Exemplary elastomers include, but are not limited to silicon containing polymers such as polysiloxanes including poly(dimethyl siloxane) (i.e. PDMS and h-PDMS), poly (methyl siloxane), partially alkylated poly(methyl siloxane), poly(alkyl methyl siloxane) and poly(phenyl methyl siloxane), silicon modified elastomers, thermoplastic elastomers, styrenic materials, olefinic materials, polyolefin, polyurethane thermoplastic elastomers, polyamides, synthetic rubbers, polyisobutylene, poly(styrene-butadiene-styrene), polyurethanes, polychloroprene and silicones. In an embodiment, a polymer is an elastomer. One example useful feature of using elastomer(s) in a HEET fluid is that it can allow the HEET fluid to withstand hoop stress as compared to water in a fluid jet. This physiochemical characteristic helps to keep jetting material from a disrupter together as the jet experiences a pressure gradient while being unconfined outside of a barrel.

The term "mechanophore" refers to a material that exhibits significant change in properties due to chemical reaction triggered by a mechanical force (strain and/or stress). One example useful feature of using mechanophore(s) in a HEET fluid is that it can allow the HEET fluid to withstand hoop stress as compared to water in a fluid jet. This physiochemical characteristic helps to keep jetting material from a disrupter together as the jet experiences a pressure gradient while being unconfined outside of a barrel.

The term "suspended" with regard to solid particles in a fluid refers to a suspension, or a mixture of solid particles in a fluid wherein the solid particles are thermodynamically favored to precipitate or sediment out of the fluid solution. The suspension may appear uniform, particularly after agitation, (i.e., solid particles macroscopically evenly distributed in the fluid). The suspension is typically microscopically heterogeneous. In an embodiment, solid particles in a suspension are one micrometer or larger in diameter, including up to 1 cm, and any sub-ranges thereof. The solid particles of a suspension may be visible to the human eye. Solid particles in a suspension may appear uniformly mixed, particularly after agitation, but are undergoing sedimentation. The solid particles may remain suspended in the solution on short time scales (e.g., less than one minute) or indefinitely kinetically (i.e., in contrast to thermodynamically). As used herein, solid particles suspended in a fluid may refer to particles fully sedimented (e.g., lead shot particles settled to the bottom of a container with a highly viscous liquid such as syrup that hinders movement of the particles). As desired, a physical barrier may be positioned in the container so as to confine particles to a specific location, particularly for fluids through which the particles may otherwise readily traverse.

The term "dispersed" in regard to solid particles in a fluid refers to a dispersion, or a microscopically homogenous, or uniform, mixture of solid particles in a fluid. Similarly to a suspension, a dispersion may be thermodynamically favored to segregate by sedimentation but wherein sedimentation is kinetically slowed or prevented. As used herein, a dispersion is a microscopically homogenous mixture having solid particles that are less than one micrometer in diameter. One example of a dispersion is a colloid (e.g., milk, tea, and coffee).

The term "jet length" refers to the length of a column of fluid propelled out of a barrel muzzle. As a fluid is propelled out of the disrupter, it tends to spread and undergo atomization. Thus, jet length may vary with time elapsed since leaving the muzzle and, consequently, vary with the distance from the muzzle. The term "atomization" refers to the dispersion of the propelled fluid into a cloud of fluid droplets. Atomization is one process that reduces the jet length and integrity. Atomized fluid is not included in the determination of jet length. The term "jet length at impact" refers to the jet length at the initial moment of impact between the fluid jet and the target. The term "jet duration" or "fluid jet duration" refers to the time until the fluid is completely atomized or dissipated and no jet, or collimated fluid, remains. The term "jet impact duration" refers to the total time the fluid jet imparts force or work on the target. The jet impact duration is a function of jet length at impact and jet velocity during impact. The term "reverse jet velocity gradient" refers to the tendency of a fluid jet back end to have a higher velocity than the fluid toward the front end of the jet, thereby effectively adversely impacting one or more jet parameters. Provided herein are various HEET fluids and related projectiles and methods that can minimize the reverse jet velocity gradient, thereby improving one or more jet parameters, including by an improvement of a jet parameter by at least 10%, at least 20%, at least 50% or at least 100% compared to an equivalent water-only jet. The term "jet fluid velocity" refers to the average velocity of the entire fluid jet or the average velocity of a leading edge of the jet.

"Volumetric destruction" refers to a disrupted, destroyed, or other physically altered volume of the target by the propelled and target impacted fluid jet. Destruction may be by physical release of material of the volume and/or functional destruction, such as release of a battery from a circuit, disruption of power circuits, or other circuit disruption, where a goal defeating an IED before an unwanted explosion occurs.

As used herein, "membrane" is used broadly to refer to a physical barrier that separates constituent components of a HEET fluid, including adjacent fluids that together form a HEET fluid. A membrane can be advantageous for preventing migration of solid particles and/or fluid from one sub-volume of the container to a membrane adjacent sub-volume. For example, the HEET projectile may include multiple fluid mixtures for the purpose of having different fluids present during the initial explosive propelling, thereby decreasing the adverse impact on jet parameter(s) associated with a reverse jet gradient. In addition, control over a sequential impact of HEET fluids on a target can be achieved. Unintentional mixing of the different fluids, or unintentional mixing of solids and fluids, before the projectile is fired, may result in forming a uniform fluid mixture that is less effective at disrupting the target. A membrane may be used within the HEET fluid projectile to separate different fluids, different fluid mixtures, solids and fluids, for example. Depending on the fluids and/or solids being separated, the membrane may correspond to a solid physical barrier where no constituents traverse, to a mesh material having a pore size that is smaller than an average particle size to confine particles to a sub-region of the container lumen, such as a proximal region.

As used herein, "cap" is used broadly to refer to a physical seal of a container end. The container end may be a distal end and/or a proximal end. Accordingly, cap may refer to a factory-sealed end or to a material that is inserted into an open end, or a material that covers an open end. Any of the caps may be temporarily punctured to facilitate complete HEET filling of the lumen, followed by sealing of the puncture passage to minimize unwanted fluid leakage.

Unless explicitly defined elsewhere, the term "substantially" refers to a value that is within 20%, 10%, 5%, of a desired value, and includes a value that is equivalent to a desired value. Qualitatively and when applied to solid particles in a fluid, substantially uniform may refer to solid particles distributed such that the concentration of solid particles in the fluid appears visibly, to the naked eye, constant throughout the fluid in which the particles are distributed.

The invention can be further understood by the following non-limiting examples.

Example 1: Overview of HEET Fluid Projectile and Related Methods

FIGS. 1-5 schematically illustrate cross-sectional views of various HEET fluid projectiles, including a HEET fluid projectile alone (FIG. 1A) and with associated components (FIGS. 1B, 2-5), including a barrel 102 of a propellant driven disrupter 100.

Figure 1B:
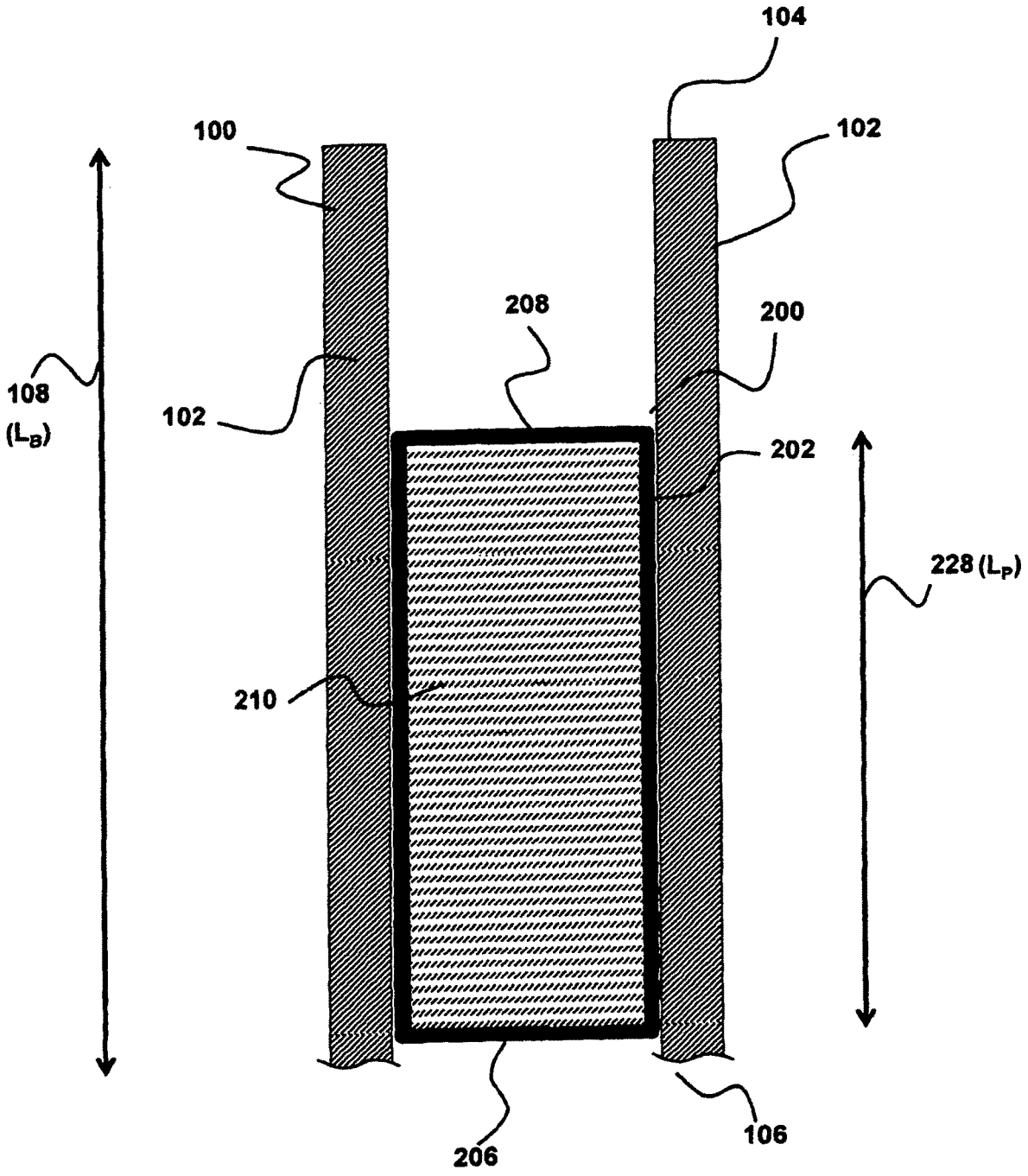
FIG. 1B is a cross-sectional view of a HEET fluid projectile positioned inside of a barrel of a propellant driven disrupter.
Figure 2:
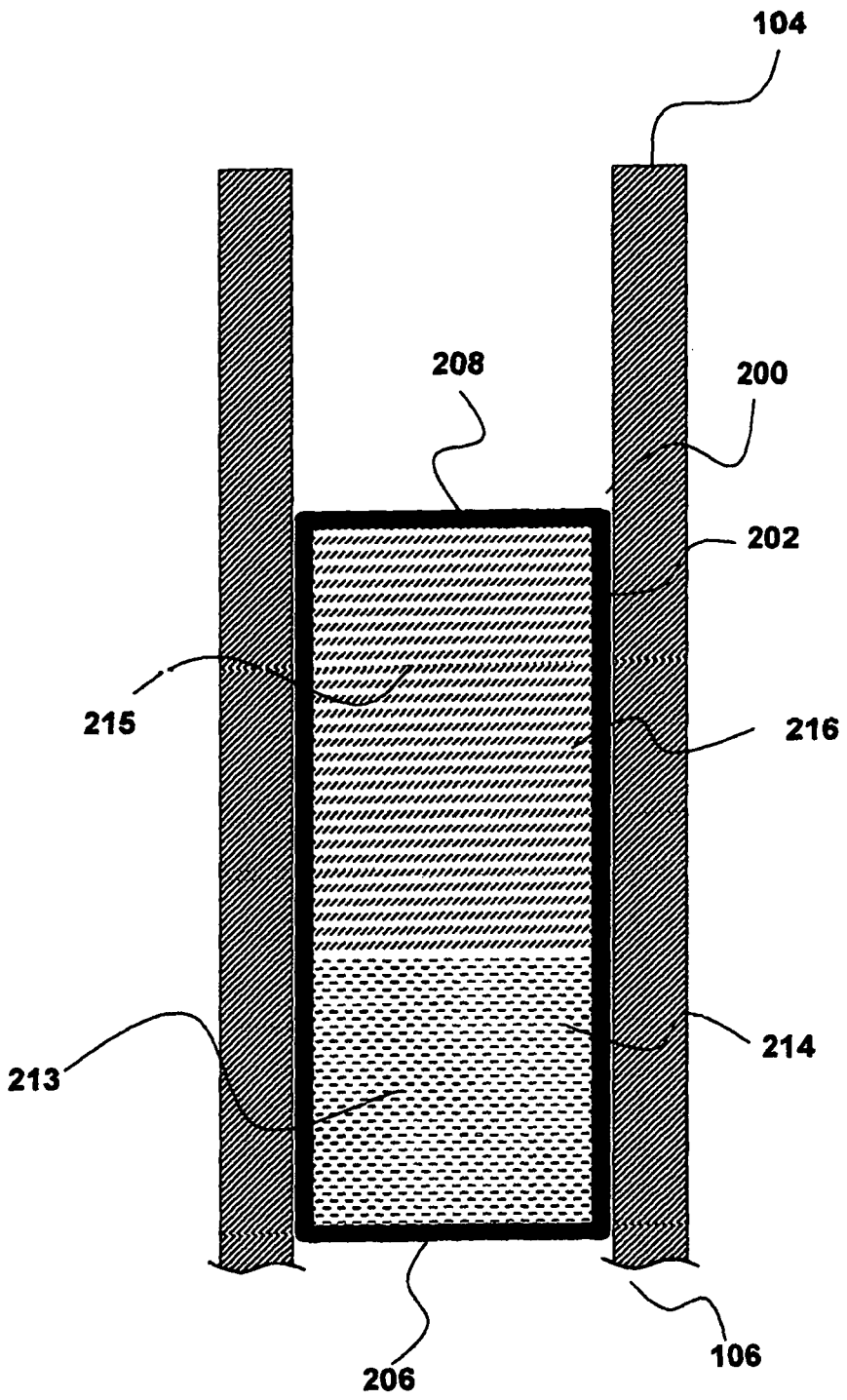
FIG. 2 is a cross-sectional view of a HEET fluid projectile positioned in a disrupter barrel, where the HEET fluid is formed of a plurality of fluids, in this example a proximal and a distal fluid.

FIGS. 1A-1B are cross-sectional views of a projectile 200 for use in disrupter, where the projectile 200 includes a friction reducing container 202 for containing and holding a HEET fluid 210 in container lumen 201, and physically separates HEET fluid 210 from the wall of barrel 102 that defines the barrel lumen (see, e.g., FIG. 2). Friction reducing container 202 may be partially formed of one or a combination of polymer, plastic, paper, and/or wax, or any other material that can reliably separate a fluid from a barrel wall in which the container is placed. For example, container 202 can be at least partially formed of polytetrafluoroethylene (e.g., Teflon®).

The outer facing surface 226 of container 202 (i.e., the container surface that faces barrel 102) may have a coating 227 that covers at least a portion of outer facing surface 226 to reduce friction between container 202 and barrel 102. Coating 227 may include one or a combination of polymer (e.g., polytetrafluoroethylene, such as Teflon®), paper, wax, a liquid lubricant, and/or a solid lubricant. Friction reducing container 202 may be cylindrical in shape with a container wall 225 having a thickness defined by an outer diameter 203 and an inner diameter 204. Outer diameter 203 of container 202 is selected to fit within barrel 102, including a diameter to ensure there is a tight-fit between the projectile and barrel so that the barrel may be positioned by hand but that will not substantially move with respect to the barrel. Outer diameter 203 may be selected to be as large as possible while still allowing HEET projectile 200 to slide into or out of barrel 102 under a user-applied hand force, including a projectile 200 that can slide out of barrel 102 when barrel 102 is held upside down and tapped or shaken. The outer diameter may be within at least 99%, at least 99.9%, or equivalent to the barrel lumen diameter. Exemplary dimensions include: inner diameter between 0.67 inches and 0.69 inches, with a wall thickness of between 0.03 inches and 0.06 inches, and corresponding outer diameter of between 0.70 inches and 0.75 inches.

Container inner diameter 204 is selected to provide a desired container lumen 201, including a desired volume of HEET fluid. The volume of HEET fluid within the lumen may be selected from the range of 40 mL to 200 mL, including about 140 mL. Container 202 has a proximal end 206 defined as the end of the container that is configured to face a breech-end portion 106 of barrel 102 and a distal end 208 defined as the end of the container configured to face a muzzle end 104 of barrel 102. Proximal 206 and/or distal 208 ends may be pre-sealed (e.g., a factory sealed end) prior to use. A user may puncture or open one of the ends to obtain fluid access to the lumen and, accordingly, fill the lumen with a HEET fluid. The puncture or opening may then be sealed, capped, or otherwise fluidically sealed to prevent unwanted moisture loss.

Projectile 200 has a longitudinal axis, being the longitudinal axis of container 202, and a projectile length ($L_P$) 228 along the longitudinal axis that is at least 10% of the barrel length ($L_B$) 108. The ratio of the projectile to barrel length is defined as $L_P/L_B$. The length ratio $L_P/L_B$ may be in range of 0.1 to 1, more preferably between 0.4 and 0.9.

Friction reducing container 202 is at least partially up to entirely filled with HEET fluid 210, such as at least 90% filled, at least 95% filled, at least 99% filled, or entirely filled. When container 202 is partially filled with fluid (e.g., HEET fluid), an air pocket is present in container 202. Container 202 may be substantially fully filled with no observable air pocket within container 202. Friction reducing container 202 may be capped at distal end 208 by a cap 220 (see, e.g., FIG. 4). Proximal end 206 may be capped. Alternatively, any of ends 206 and/or 208 may be "factory" sealed with HEET fluid 210 inside or such that HEET fluid 210 can be user-added by injection or by making an opening at either end, providing the HEET fluid, and subsequently capping or otherwise fluidically sealing the ends. Optionally, an adhesive 224 (e.g., see FIG. 4) is applied between cap 220 and distal end 208 to provide further reliable fluidic seal. Projectile 200 containing HEET fluid and appropriately protected against fluid loss can have a relatively long life-time. For example, the projectile may be stored for at least 6 months to 12 months before use without any substantial degradation in functional outcome.

Any of the HEET fluid projectiles 200 disclosed herein may include a HEET fluid that is one or a combination of water, oil(s), syrup(s), ionic solution(s), alcohol(s), liquid polymer(s), pre-polymer(s), elastomer-containing liquid(s), clays and mechanophore(s).

Figure 3:
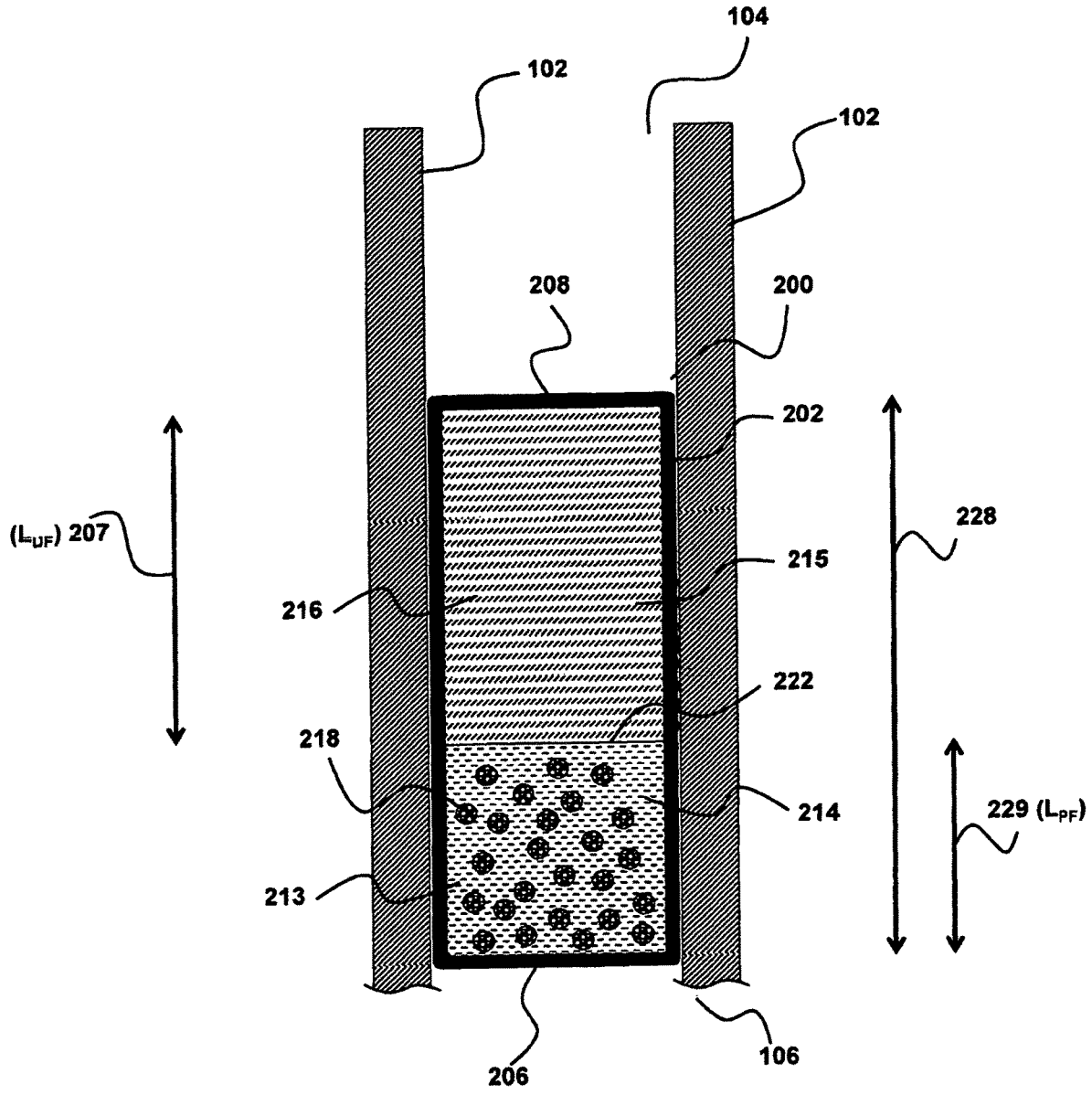
FIG. 3 is a cross-sectional view of a HEET fluid projectile with a membrane separating the proximal and distal fluids. Solid particles are suspended in the proximal fluid.
Figure 4:
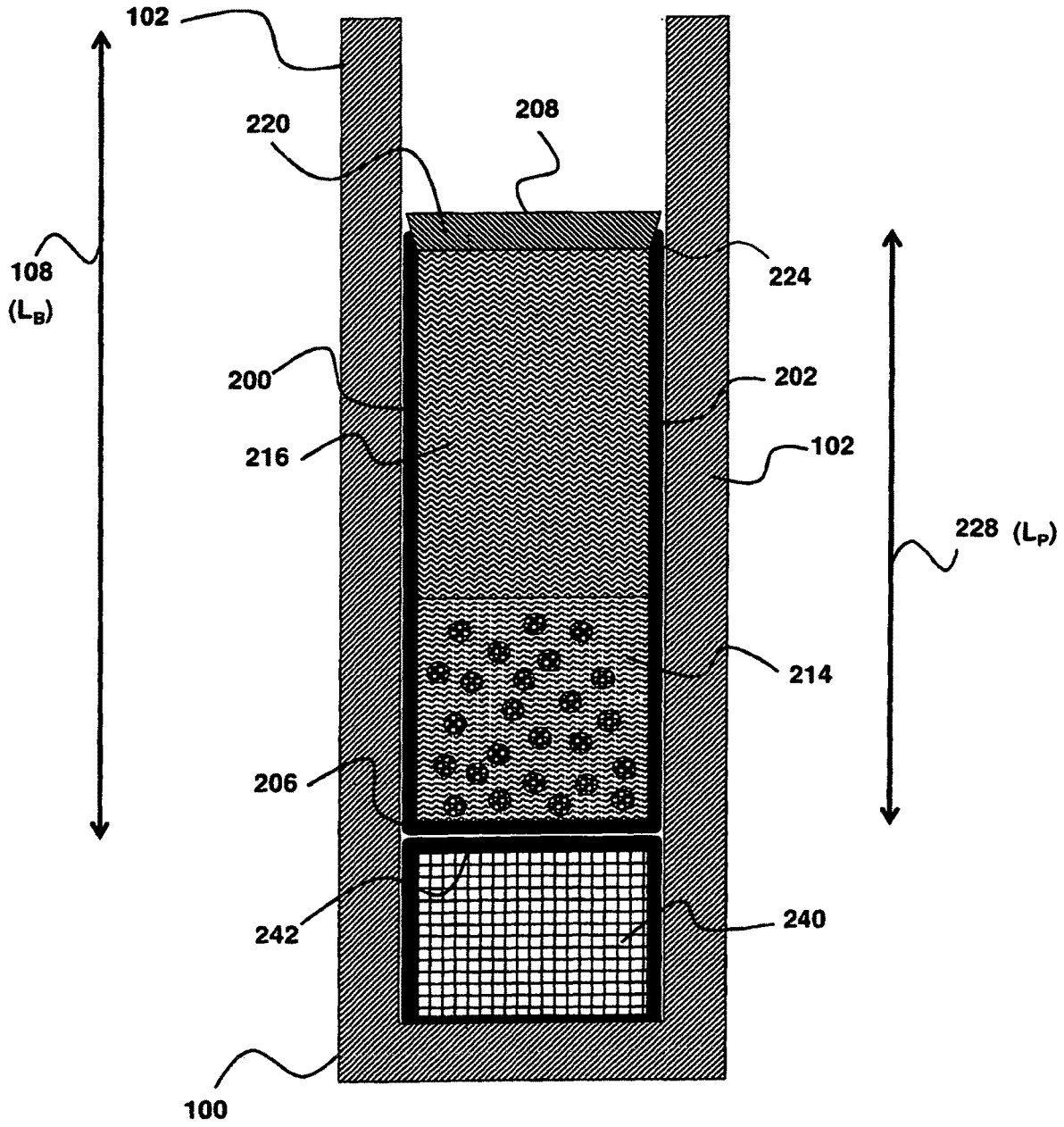
FIG. 4 is a cross-sectional view of a HEET fluid projectile abutting an explosive cartridge in a disrupter barrel.
Figure 5:
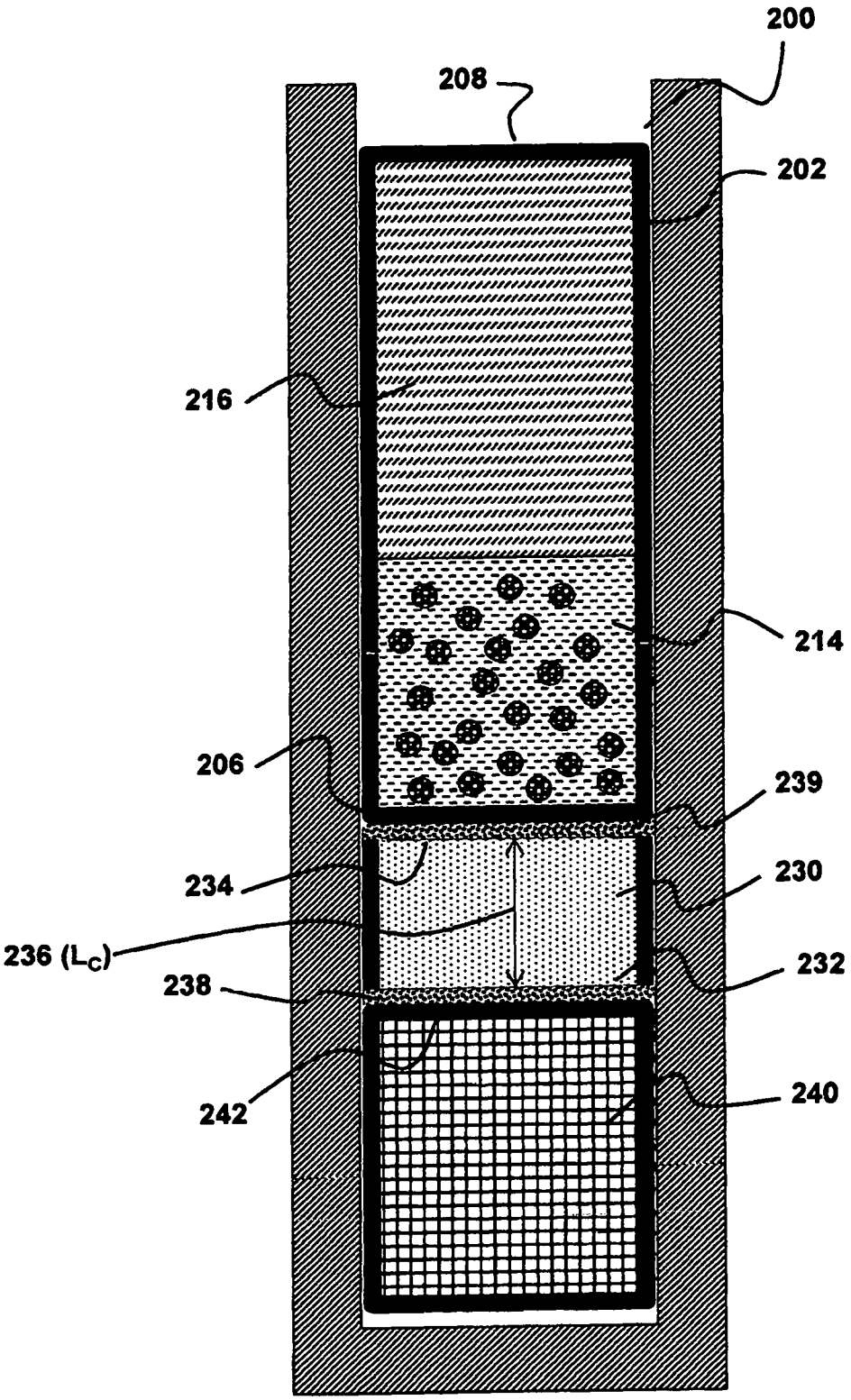
FIG. 5 is a cross-sectional view of a HEET fluid projectile and a connector that connects the friction reducing container to the explosive cartridge.

FIGS. 3-5 illustrate a HEET fluid 210 that is a mixture of at least one fluid and solid particles 218 suspended therein. HEET fluid 210 may include a Newtonian fluid, a semi-solid, or both a Newtonian fluid and a semi-solid. Solid particles 218 may be suspended and/or dispersed in the fluid portion of the HEET fluid. Exemplary solid particles 218 include, but are not limited to, clay, steel shot, lead shot, plastic beads, sand, metallic microparticles (e.g., tungsten), garnet microparticles, ceramic powder, wood dust, plastic dust, or any combination of thereof. For example, the HEET fluid mixture may be a mixture of sand and syrup, such as corn syrup. Solid particles 218 may be dispersed in the HEET fluid mixture uniformly. Alternatively, solid particles 218 may be distributed non-uniformly in the HEET fluid mixture, such that HEET fluid 210 has an effective density gradient due, at least, to the non-uniform distribution of solid particles 218. In a further example, all solid particles 218 may be positioned or confined at proximal end 206, including with a membrane 222.

FIG. 2 is a cross-sectional view of HEET fluid projectile 200 in barrel 102, including friction reducing container 202 that has a proximal HEET fluid zone 213 filled with a proximal HEET fluid 214, positioned nearer to proximal end 206, and a distal HEET fluid zone 215 filled with a distal HEET fluid 216, positioned nearer to distal end 208. The projectiles provided herein may be compatible with or without a membrane or separator that separates fluid zones 213 and 215. For example, a fluid that polymerizes or otherwise adopts solid-like properties after pouring into container lumen defined by inner diameter 204, may be sufficiently confined to proximal fluid region 213, and a subsequent fluid that is introduced may be positioned in distal fluid zone 215.

An advantage of having distinct proximal fluid 214 and distal fluid 216 is that the resulting HEET fluid jet, formed after expelling the HEET fluid from the barrel, may have a distal set of characteristics nearer to the distal jet end and a proximal set of characteristics nearer to the proximal back-end of the jet. The proximal and distal fluids may be selected to have different effects on the target IED. Another advantage of having proximal and distal fluids is to minimize fluid jet collapse or degradation otherwise caused by the reverse jet velocity gradient, wherein the proximal or back end of the jet has a higher velocity than the distal or front end of the jet. This can be achieved, for example, by selecting the proximal and distal fluids, including proximal fluid having higher density, viscosity, solid particles, and the like. Proximal fluid 214 may have one or more physical properties that are different from distal fluid 216. Exemplary different physical properties include, but are not limited to, a higher effective density and/or higher effective viscosity of proximal fluid 214 compared to distal fluid 216. Proximal fluid 214 and distal fluid. 214 may separate naturally (e.g., according to density and/or hydrophobicity) within friction reducing container 202, as depicted in FIG. 2. FIG. 2 depicts proximal fluid 214 and distal fluid 216 forming an abrupt, or discontinuous transition between two respective fluid zones 213 and 215. Each fluid zone is a volume within container 202 substantially comprising a unique HEET fluid composition (i.e., proximal fluid 214 or distal fluid 216). In other embodiments, a continuous gradient of effective density and/or effective viscosity exists between proximal fluid 214 and distal fluid 216.

Exemplary distal fluid 216 includes water, syrup(s), liquid polymer(s), elastomer-containing liquid(s), alcohol(s), oil(s), ionic solution(s), and/or mechanophore(s). Exemplary proximal fluids 214 include a fluid having a higher effective density and/or viscosity than water, such as syrup(s), liquid polymer(s), elastomer-containing liquid(s), alcohol(s), oil(s), ionic solution(s), and/or mechanophore(s). Proximal fluid 214 may further include a plurality of solid particles 218 (e.g., see FIG. 3). In this example, proximal fluid 214 and distal fluid 216 may be considered together as forming HEET fluid 210. Similarly, projectiles 200, described herein, are compatible with any number of HEET fluids, such that container 202 may include one, two, or more than two HEET fluids, each having a unique composition. Proximal zone 213 may have solid particles suspended in a liquid, a semi-solid, or a polymerized material, or may have solid particles without liquid. As described, each of two adjacent HEET fluids in container 202 may have the features described above for proximal fluid 214 or distal fluid 216, respectively.

FIG. 3 is a cross-sectional view of HEET fluid projectile 200 including any combination of features of HEET projectile 200, described above, with a membrane 222 to separate proximal fluid 214 and distal fluid 216. Membrane 222 minimizes or prevents migration of either of proximal fluid 214 or distal fluid 216, or any constituent(s) thereof, across membrane 222 and between adjacent fluid zones. In this example, proximal fluid 214 includes solid particles 218. Proximal fluid zone 213 has a length ($L_{PF}$) 229 and distal fluid zone as a length $L_{DF}$ 207, each of which are collinear with the longitudinal axis of projectile 200, such that $L_{PF}+L_{DF}\approx L_P$ (the projectile length ($L_P$) 228). Exemplary ratios include $0.01\leq L_{PF}/L_{DF}\leq 10$. Optionally, each of $L_{PF}$ and $L_{DF}$ may be defined relative to $L_P$, such as $0.01\leq L_{PF}/L_P\leq 0.9$ and/or $0.01\leq L_{SF}/L_P\leq 0.95$. Proximal fluid 214 and distal fluid 216 have properties so as to achieve desirable fluid jet parameters suitable for the application at hand. Container 202 may include more than two fluid zones, each having a unique fluid composition, and container 202 may include more than one membrane 222. Container 202 can, however, include adjacent fluid zones not separated by membrane 222, particularly for situations where fluid migration is not of concern.

FIG. 4 is a cross-sectional view of a HEET fluid projectile 200 and an explosive cartridge 240 in disrupter 100. More specifically, projectile 200 is positioned within a barrel having barrel length $L_B$ (108), defined as the distance between the distal end of the explosive cartridge 240 and the barrel muzzle end 104. The projectile length $L_P$ (228) corresponds to the longitudinal length of the fluid containing portion and associated container 202 ends. The invention is compatible with a range of $L_P/L_B$ values, including $0.1\leq L_P/L_B\leq 1$, and any subranges thereof. Proximal end 206 of friction reducing container 202 abuts distal end 242 of explosive cartridge 240 within barrel 102. Explosive cartridge 240 is configured to be detonated in order to propel HEET fluid 210, illustrated in FIG. 4 as including proximal fluid 214 and distal fluid 216, out of barrel 102. Container 202 may or may not exit barrel 102 when cartridge 240 is fired. Explosive cartridge 240 includes an explosive material such as gunpowder and a primer capable of detonating the explosive material within explosive cartridge 240. Explosive cartridge 240 may be closed at its proximal end and its distal end 242. Optionally, container 202 and explosive cartridge 240 share a common wall at projectile proximal end 206 and cartridge distal end 242, respectively. Cartridge 240 may be a blank shotgun round, including any conventional commercially-available cartridges used with conventional disrupter systems.

FIG. 5 shows a cross-sectional view of HEET fluid projectile 200 with a connector 230 to connect the container 202 and explosive cartridge 240. Connector 230 has a proximal end 232 and a distal end 234. Proximal end 206 of container 202 is connected to distal end 234 of connector 230. Proximal end 232, of connector 230, is connected to distal end 242, of explosive cartridge 240. Optionally, connector 230 includes a proximal adhesive 238 to bond proximal end 232 to distal end 242 and a distal adhesive 239 to bond proximal end 206 to distal end 234. Connector 230 may be, for example, a hollow tube. In another example, connector 230 may be the hollow case of a shotgun shell. Connector 230 has a length 236 co-linear with the longitudinal axis of projectile 200. Length 236 defines the separation distance between container 202 and explosive cartridge 240. Length 236 is selected to achieve desired properties of HEET fluid 210, including proximal fluid 214 and distal fluid 216 in those embodiments where present, after it is propelled out of the barrel. For example, length 236 is selected to achieve a user-selected propelled HEET fluid velocity. Depending on the IED parameters and desired disruption parameters, fluid velocity may be selected accordingly. Accordingly, the devices and methods provided herein are compatible with a range of connector lengths (Lc, (236).

HEET fluid 210 is selected to have certain fluid properties to enable or achieve desired parameter(s) with regard to disruption of a target explosive, including fluid jet parameters or properties, including at target impact. As noted, HEET fluid 210 may include a single fluid, be a uniform fluid mixture throughout container lumen, or be a composite of physically distinct fluids, including a composite that is a combination of fluids, fluid mixtures, fluid zones, and/or solid particles 218. HEET fluid properties include effective viscosity, viscosity gradient, effective density, density gradient, surface tension, presence of solid particles, average size of solid particles, number and composition of each unique HEET fluid or fluid mixture, freezing point, and Reynolds number of propelled HEET fluid in barrel 102. Overall HEET fluid 210 as well as each constituent unique fluid or fluid mixture composition, or fluid zone, if more than one if present, is defined by its fluid properties. Desired target disruption parameters include jet velocity, jet length at impact, jet impact duration, jet reverse velocity gradient, a measure of atomization, target penetration depth, momentum and energy transfer to target, volumetric disruption of target, and maximum stand-off distance required to inactivate target, where stand-off distance is the distance between the propellant driven disrupter and the target.

HEET fluid projectile 200 may be configured to achieve improved target disruption parameter(s) compared to those achieved by a conventional water projectile in a propellant driven disrupter. For example, HEET fluid 210 may be selected to achieve one or a combination of the following parameters compared to a conventional projectile formed of water placed in barrel 102: increased jet length at impact, increased jet effective diameter on impact, increased jet impact duration, decreased jet reverse velocity gradient, decreased atomization, increased target penetration depth, increased momentum and energy transfer to a target, and increased stand-off distance while maintaining target inactivation. Other features the HEET fluid projectiles, such as connector length, may be selected to achieve the above mentioned target disruption parameters. Use of HEET projectile 200 may result in a penetration depth that is at least 1.2 times greater than the penetration depth achieved via a conventional water jet propelled from an equivalent propellant driven disrupter. Use of HEET projectile 200 may result in target disruption (inactivation) at a stand-off distance that is at least two times greater the stand-off distance required for target disruption using an equivalent disrupter with a water projectile (including water poured into the barrel).

In any of the embodiments disclosed herein, HEET fluid 210, and/or any of its constituent fluid (or fluid mixture) compositions, has an effective viscosity selected from the range of 1 cP to 100,000 cP at 20° C. In any of the embodiments disclosed herein, HEET fluid 210, and/or any of its constituent fluid (or fluid mixture) compositions, has an effective density selected from the range of 0.5 g/mL to 15 g/mL at 20° C. Any of the HEET fluids 210, and/or any of the constituent fluid (or fluid mixture) compositions, may have an effective density selected from the range of 1.1 g/mL to 15 g/mL at 20° C. In any of the embodiments disclosed herein, HEET fluid 210, and/or any of its constituent fluid (or fluid mixture) compositions, has surface tension selected from the range of 70 mN/m to 510 mN/m cP at 20° C. In any of the embodiments disclosed herein, HEET fluid 210, and/or any of its constituent fluid (or fluid mixture) compositions, when propelled, has a Reynolds number, in the barrel, selected from the range of 75 to 4000. In any of the embodiments disclosed herein, HEET fluid 210, and/or any of its constituent fluid (or fluid mixture) compositions, has a freezing point that is less than or equal to −40° C., that is less than or equal to −20° C., or that is greater than or equal to −20° C.

Figure 6A:
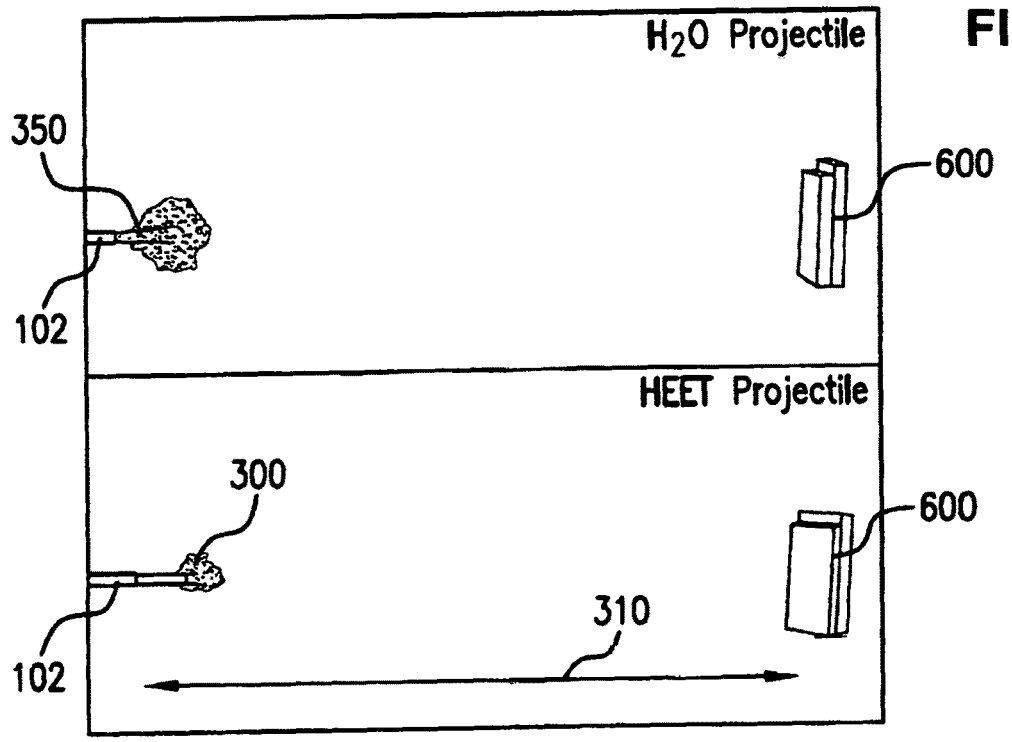
FIGS. 6A-6D are screen grab images from a high speed video of a water jet (top portion of each of FIGS. 6A-6D) and a HEET fluid (syrup-sand mixture) jet (bottom portion of each of FIGS. 6A-6D) fired from a propellant driven disrupter at a target (PAN propelled with BK40 cartridges).
Figure 6B:
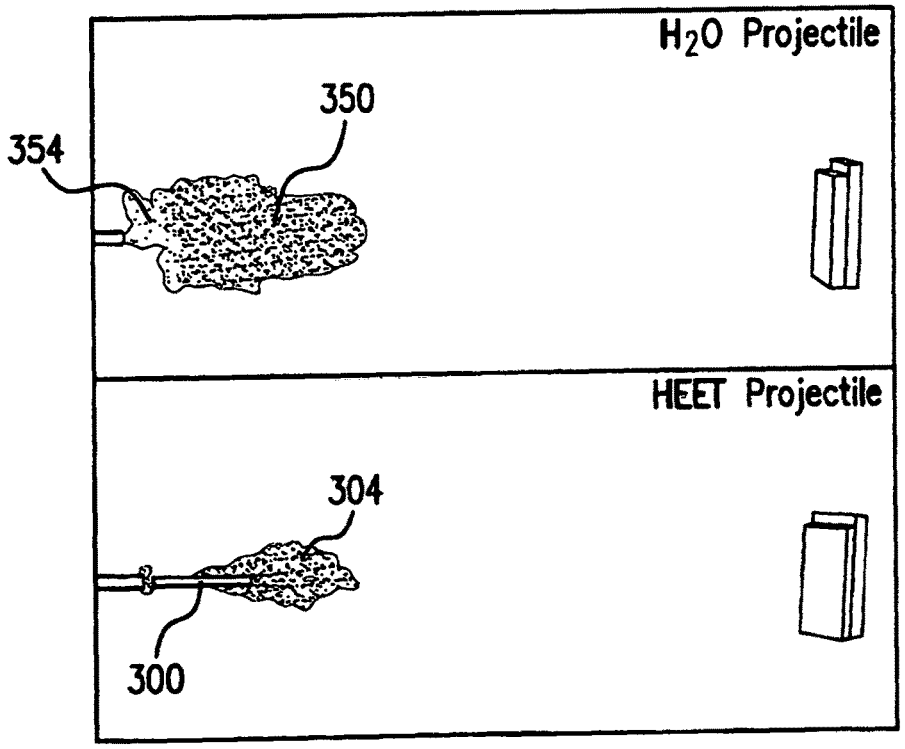
Figure 6C:
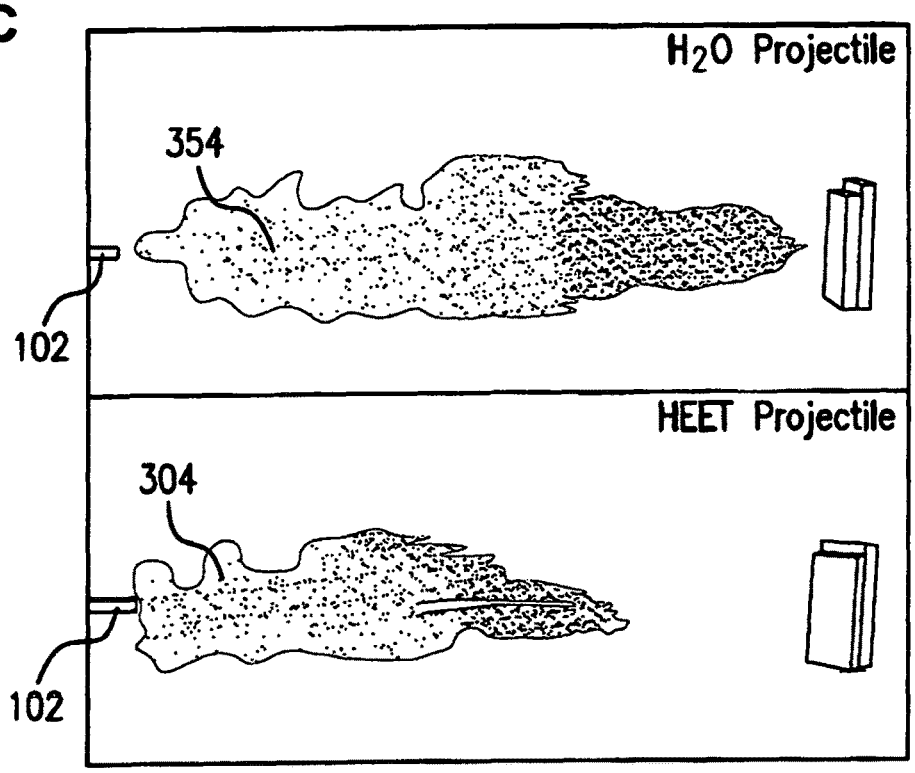
Figure 6D:
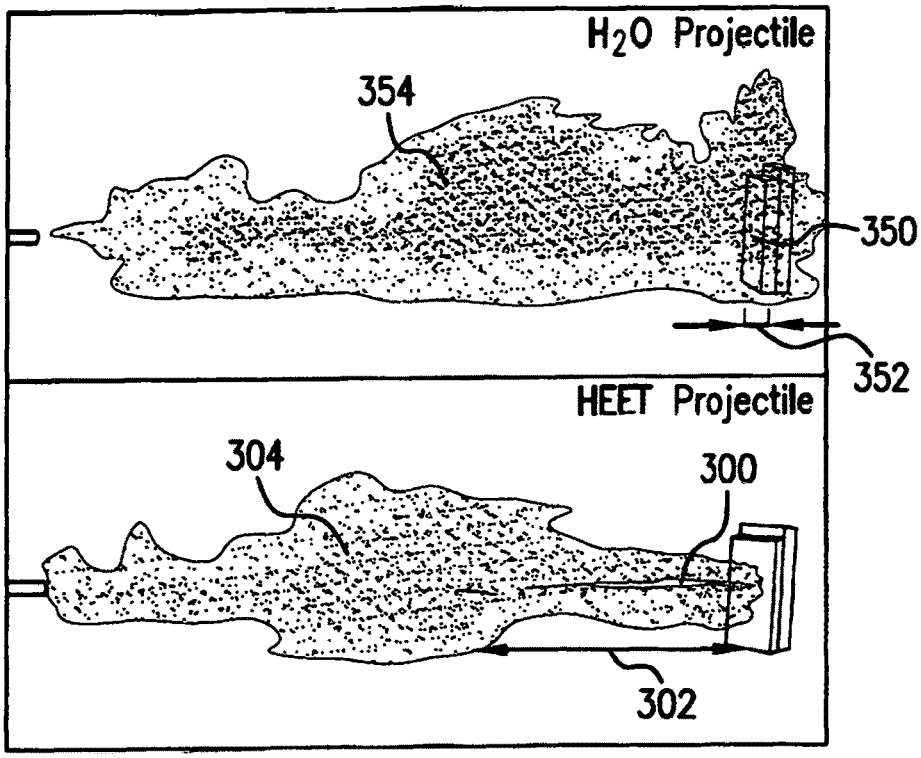

FIGS. 6A-6D are time lapse images of a fluid shot from a disrupter with each panel having a top (conventional water-filled barrel) and a bottom (HEET projectile) image. Each of FIGS. 6A-6D is a snapshot from a high-speed video as the expelled fluid jet moves from the disruptor barrel (FIG. 6A) and contacts a target 600 (FIG. 6D), so that the expelled fluid jet travels in the left to right direction. The firing conditions in the top and bottom panels are similar, with an equivalent disrupter and barrel 102, stand-off distance 310 and target 600. FIG. 6A shows an initial moment when the respective fluid (water—top panel or HEET—bottom panel) exits barrel 102. The jet formed by the water propelled out of the disrupter (water jet 350) expands at a rate faster than does the jet formed by the HEET fluid (HEET fluid jet 300). FIGS. 6B-6D demonstrate that water jet 350 experiences a greater degree of atomization than does HEET fluid jet 300, as reflected by the cloud of water jet atomization 354 that is larger than the cloud 304 of HEET fluid jet atomization (FIGS. 6B-6D). FIG. 6D also demonstrates that HEET fluid jet 300 remains more collimated and defined than water jet 350 at the moment of impact, with such a large water atomization and attendant cloud that no clear jet is readily observed (compare top and bottom panels of FIG. 6D). Accordingly, the HEET projectile results in at least greater jet length at impact (352 in case of water and 302 in case of HEET fluid), greater jet impact duration, and better work done on target compared to the water projectile. For example, water jet at impact 352 may be less than 2 inches long at a distance when stand-off distance 310 is 6 to 8 feet.

Figure 7A:
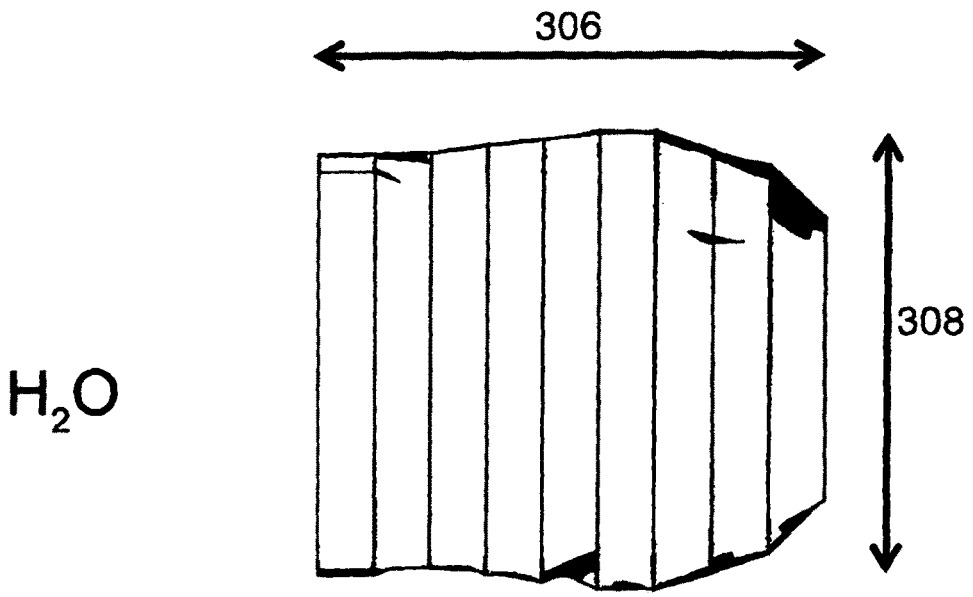
FIG. 7A-7B are comparisons of penetration profiles of a water projectile (FIG. 7A) and a HEET fluid (syrup-sand) projectile (FIG. 7B), each fired from a Titan Main Barrel (MB) disrupter with a BK90 cartridge at a 3" stand-off distance, illustrating improved penetration characteristics of the HEET fluid projectile. This comparison also shows better collimation of the HEET projectile due to reduced atomization and viscosity.
Figure 7B:
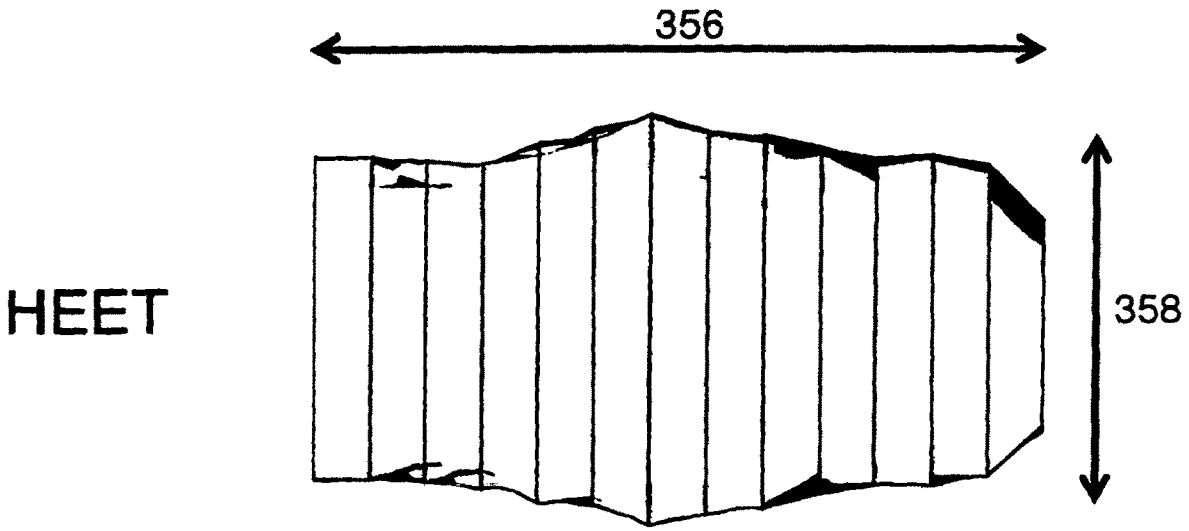

The improved jet parameters illustrated in FIGS. 6A-6D correspondingly result in improved target penetration, as quantified in the penetration profile renderings of FIGS. 7A and 7B for water jet (top panel) and HEET jet (bottom panel), respectively. The disrupter and explosive cartridge, stand-off distance, fluid volume and target are equivalent in the test (as illustrated in FIGS. 6A-6D). The HEET fluid projectile used in the test generally corresponds to that of FIG. 1A, having a syrup-sand HEET fluid composition. The HEET fluid projectile results in a greater penetration depth 356 compared to the penetration depth 306 for water. The HEET fluid penetration is also more confined, with a smaller average penetration diameter (compare HEET penetration diameter 358 to water penetration diameter 308). The penetration profile of a HEET fluid is confined to smaller cross-sectional area but with a significantly improved penetration depth, due in part to reduced fluid jet atomization and jet disruption for a HEET fluid compared to water, as illustrated by FIG. 6D. The HEET fluid projectile improved penetration depth demonstrates the usefulness of a HEET fluid projectile to effectively and reliably disrupt targets that are hardened or are positioned such that the stand-off distance to the disrupter may be larger. Of course, as the penetration in FIGS. 7A-7D is for a solid sets of plywood, the penetration profile during use against a target having internal granule-like explosive ingredient, may be much larger. The internal disrupted volume, illustrated by FIGS. 7A-7B, can be calculated from the average diameter and penetration depth. HEET fluid 210 can accordingly be tailored specifically to the application of interest, such as to maximize penetration, optimize contact surface area, increase initial momentum transfer (shorter and faster jet), or to prolong the momentum transfer (longer jet length, slower velocity). The ability to independently control the composition of multiple different HEET fluids in the projectile provides a number of functional benefits, as parameters that may otherwise be at cross purpose (e.g., good penetration depth and prolonged momentum transfer) can be independently controlled (e.g., lead shot in proximal fluid, and no lead shot in distal fluid). Alternatively, a HEET fluid can made to have low or no penetration of an explosive (e.g., IED) casing, but significantly cause target deformation and momentum transfer. Casing deformation may cause material inside the bomb to displace and dislodge a bomb lid and transferred momentum to cause the internal material to fly out and separate.

The HEET fluid projectiles described herein may include any combination of the features of HEET fluid projectile 200, including those illustrated in FIGS. 1-5. A HEET fluid projectile may further include an explosive cartridge 240, connector 230, and HEET fluid 210 in container 202. At its simplest, the HEET fluid may have a single composition, or single fluid zone. To provide additional refined control of jet characteristics, including tailored to the specific properties of the target and surrounding environment, the HEET fluid may have a proximal fluid 214 and distal fluid 216. In any of the embodiments described herein, the preparation of the HEET projectile, including filling of container 202 with appropriate HEET fluid 210, may occur on site or be prepared in advance off-site.

Figure 8:
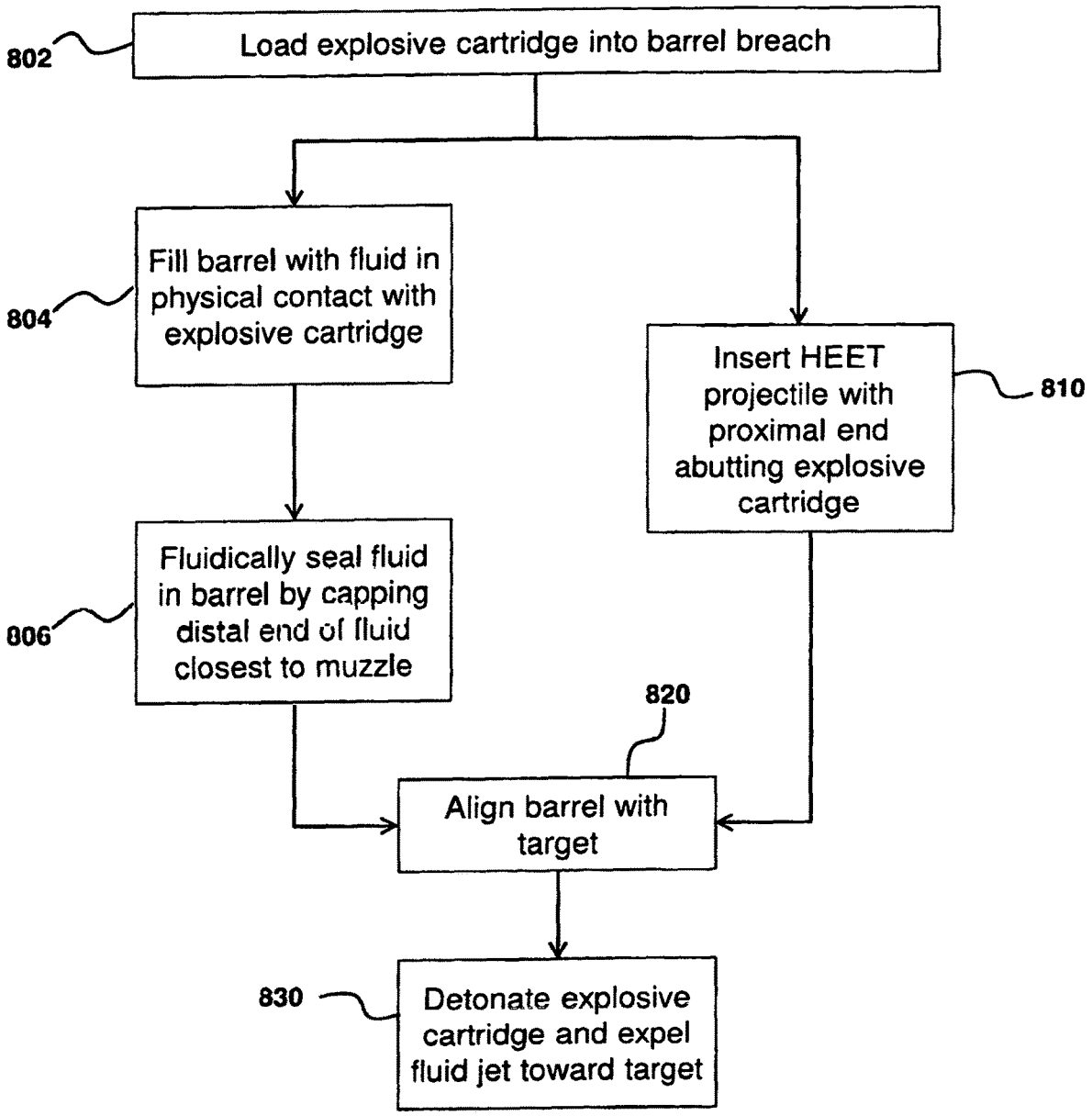
FIG. 8 is a flowchart summary of exemplary methods of preparing a propellant driven disrupter for use in disrupting a target, such as an IED.

FIG. 8 is a flowchart illustrating exemplary procedures for preparing a propellant driven disrupter for use. In step 802, an explosive cartridge (see, e.g., cartridge 240 in FIG. 4 or 5) is loaded into the barrel breach of propellant driven disrupter 100. The barrel breach is the portion of propellant driven disrupter 100 that is intended to house an explosive for propelling the fluid (e.g., water or HEET fluid).

In step 804, the lumen of barrel 102 is filled with fluid such that the fluid is in direct physical contact with explosive cartridge. The fluid may be water or other fluid having a composition that does not unduly interact with barrel surface, plug, or otherwise result in damage to the barrel and/or catastrophic pressure build-up during firing. For example, the fluid may be water. In this embodiment, container 202 is not required and the fluid may be in physical contact with the inside surface of the barrel. This is fundamentally different form conventional water filled disruptors, where an additional physical barrier is positioned between the fluid and the explosive cartridge, to avoid fluid coming into physical contact with the explosive cartridge. That physical separation was believed important so as to maintain efficacy of the explosive cartridge and resultant jet. It is found, however, that no such physical separation is required to maintain good jet characteristics. In step 806, the fluid introduced into the barrel in step 804 is fluidically sealed within barrel 102. Step 806 may be achieved by capping muzzle end 104 of barrel 102. Alternatively, step 806 may be achieved by applying a cap or seal within barrel 102 (i.e., in the barrel lumen). In one example of steps 804 and 806, barrel 102 is fully, or almost fully, filled with the fluid and the fluid is fluidically sealed by capping barrel muzzle end 104. In another example of steps 804 and 806, barrel 102 is partially filled (e.g., half of the barrel length is unfilled) and the fluid is fluidically sealed by inserting a cap or seal into the barrel lumen, with air pockets between the fluid and the cap avoided or minimized. To avoid an unwanted air pocket, the sealing may be done by applying a cap with a tiny hole to accommodate movement of air and fluid as the cap is brought into contact with the fluid, but without undue fluid leakage, followed by sealing the hole in the cap.

As illustrated in FIG. 8, step 810 relates to placement of a HEET projectile 200, such as any shown in FIGS. 1B-5, into the lumen of barrel 102 such that proximal end 206 abuts explosive cartridge 240. The insertion step 810 may be simpler in that the projectile may be inserted efficiently and reliably in a single step, whereas at least steps 804 and 806 are associated with fluid filling of the barrel. In certain embodiments, HEET projectile 200 includes explosive cartridge 240 (see, e.g., FIG. 5), optionally physically abutting container 202 at proximal end 206 (see, e.g., FIG. 4), so that steps 802 and 810 are conceptually a single step. An advantage of combining steps 802 and 810 by using HEET projectile 210 that includes explosive cartridge 240 is minimizing the possibility of loading the HEET projectile backwards (e.g., having fluid intended to be proximal fluid 214 positioned nearer to muzzle end 104), further minimizes time on target, and minimizes the number of separate components brought onto target by a bomb technician.

In step 820, the disrupter, specifically the barrel 102, is aligned with a target. The stand-off distance may also be selected to achieve desired target disruption parameters, taking into account target parameters (e.g., target encasement; explosive materials, electronic circuitry, trigger, target geometry) and the propellant or HEET projectile parameters (e.g., water or HEET fluid 210 and composition thereof).

In step 830, explosive cartridge is detonated such that fluid (e.g., water or HEET fluid) is propelled out of the disrupter barrel toward the target. Explosive cartridge 240 may be detonated by any means known in the art, include wired and wireless methods.

Figure 9:
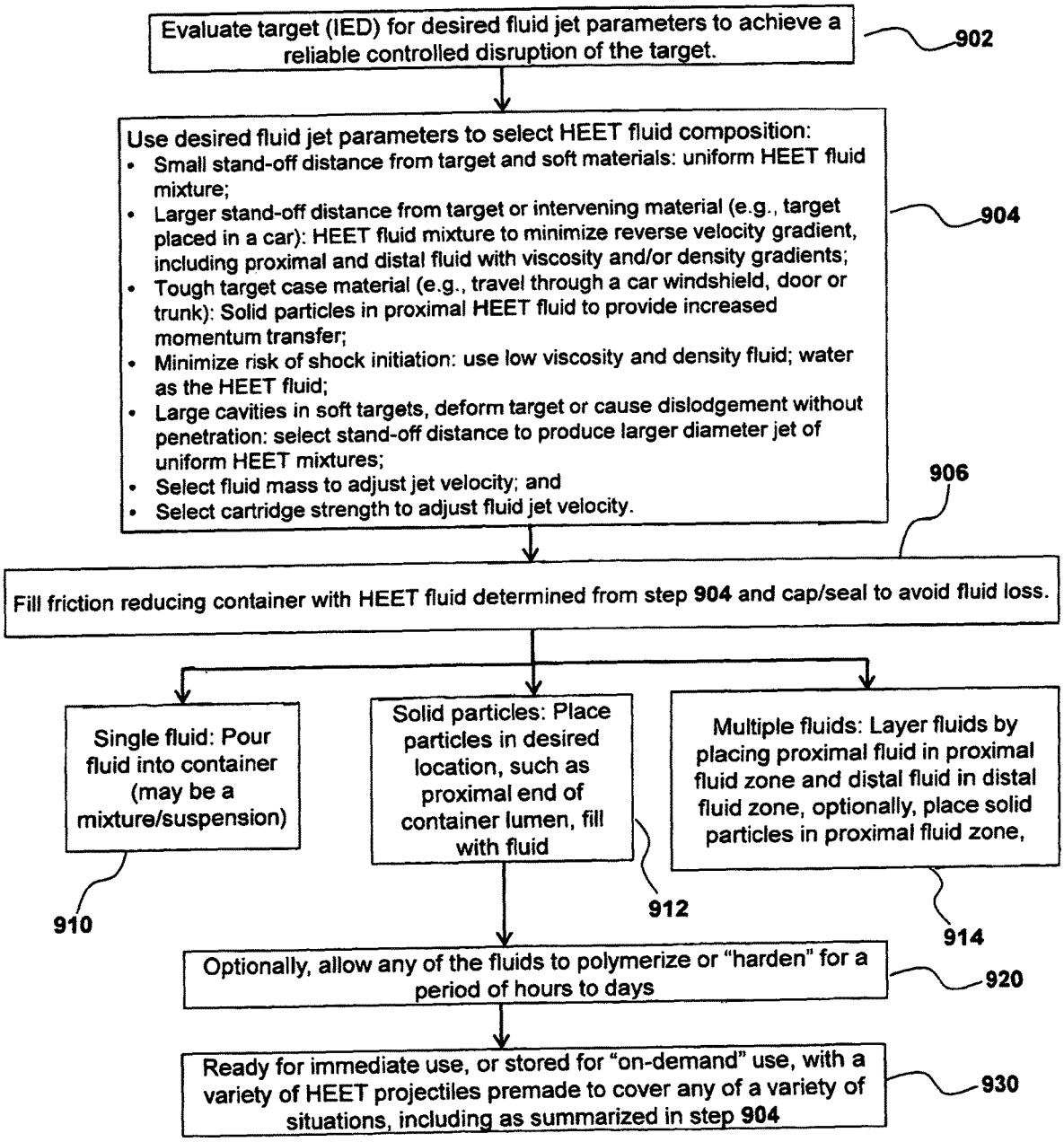
FIG. 9 is a flow chart summary of method of selecting and making a HEET fluid projectile for use in a propellant driven disrupter.
Figure 10:
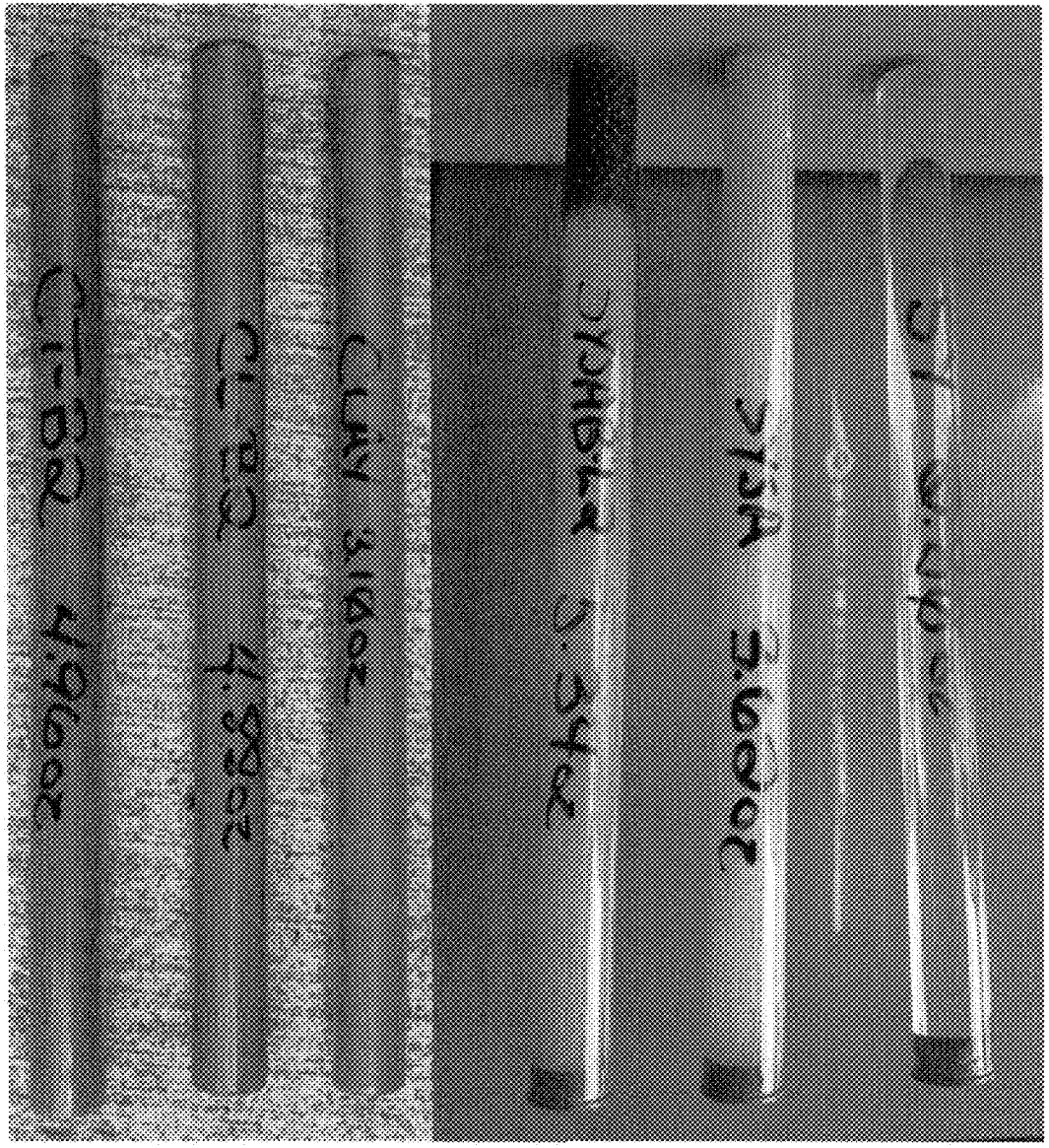
FIG. 10 is photographs of various HEET fluid projectiles having different HEET fluids or combinations thereof, such as, corn syrup (Sy), corn syrup and sand (Sa) mixture, corn syrup-sand mixture with lead shot (L), clay (C), and clay with tungsten dust.

FIG. 9 is a flowchart summary illustrating exemplary procedures for designing and selecting fluids for use in projectile 200, including the HEET fluid projectile used in step 810 of FIG. 8. In step 902, a target is evaluated with regard to fluid jet parameters needed to achieve reliable and controlled disruption of the target. Parameters of target considered include, but are not limited to, the presence and properties of encasing materials, presence and properties of detonation electronics, type of explosive material, position, shape and location of target (which dictates in part available stand-off distance options), surrounding environment. Fluid jet parameters considered include, but are not limited to, any of the fluid jet parameters described herein.

Step 904 illustrates the flexibility of the instant invention with respect to tailoring projectile to a target of interest. The HEET fluid may be selected according to any number of desired fluid jet parameters, with the desired fluid jet parameters influenced, in turn, by the evaluated target parameters and desired target disruption as determined in step 902. Step 904, illustrates exemplary non-limiting fluid jet and target parameters and HEET fluid properties that may be selected or determined accordingly. For example, if a short stand-off distance is used and the target is composed of soft materials, then HEET fluid 210 having a uniform fluid mixture may be selected. In another example, if a longer stand-off distance is used and/or there is an intervening material between the target and the barrel (e.g., car window), then HEET fluid 210 having proximal and distal fluids 214 and 216, may be selected to minimize the reverse jet velocity gradient, thereby ensuring that HEET fluid jet 300 remains sufficiently intact (i.e., minimal atomization) at the point of final target impact, even for relatively long stand-off distances. If target is encased with a tough or shaped material (e.g., metals, pressure cooker, oil drum, inside a vehicle), a HEET fluid may be selected to include solid particles (e.g., lead shot) in proximal fluid 214 to provide increased momentum transfer allowing HEET fluid jet to penetrate the encasement. In another example, for a target that is sensitive to shock initiation, water or other low viscosity and low density may be selected. The jet velocity can be reduced by selecting lower strength cartridges which also reduces risk of shock initiation. These are but a few examples that illustrate the ability to tailor the projectile of the instant invention to any of a number of situations. Such a versatile platform is simply not available with conventional water cannons, where the only variables that are adjustable is disruptor type, stand-off distance, water volume, and explosive cartridge. An additional example of tunable variables associated with HEET fluid projectiles and resulting effects is using increased standoff, increased viscosity, and lower density to produce larger diameter jets of uniform HEET mixtures. This jet profile is useful for soft targets to create huge cavities and disruption cross section or to create portals for example in laminated glass up to 5" in diameter using the TiTAN MB disrupter. This jet profile is also useful when penetration is not desired and target deformation is desired. The impulse causes dislodgement disablement. Examples of applications for this jet profile include defeat of pressure cooker bombs, trunk access or breeching of doors where barrier deformation rather than penetration is desired. In the case of a trunk, the HEET shot compromises the lock and forces the trunk to lift open. For pressure cookers, the inertial transfer causes the explosives and other interior components to move and the bomb tears itself apart. Adjusting the length of the HEET projectile relative to barrel length is also another method to control penetration and stabilize the HEET jet (e.g., a 12 inch container of HEET fluid can be placed in a PAN with a 21.75" barrel).

In step 906, friction reducing container 202 is filled with the HEET fluid 210 selected in step 904 and container 202 is capped/sealed to avoid fluid loss. Steps 910, 912, and 914 are exemplary and optional examples for filling container 202, depending on the HEET fluid composition. In step 910, container 202 is filled with a single fluid, which may be a mixture of multiple fluids and/or a suspension (e.g., sand mixed with corn syrup). In step 912, solid particles 218 (e.g., lead shot or other density/mass enhancing solid material) is placed in container 202, such as at proximal end 214, and container 202 is filled with fluid, which may be a mixture of multiple fluids and/or a suspension. Of course, the fluid may be filled first, with solid particles later introduced and allowed to settle in proximal fluid. In step 914, container 202 is filled with proximal fluid 214, defining proximal fluid zone 213, and then filled with distal fluid 216, defining distal fluid zone 215. Solid particles 218 may be placed in proximal fluid zone 213, as desired.

In optional step 920, HEET fluid, or any constituents thereof, is allowed to polymerize or "harden" for a period of hours to days. Optionally, this step may include initiating or accelerating polymerization via, for example, applying ultraviolet light and/or heat. Step 920 may be performed to increase the viscosity of HEET fluid, or any of the constituent fluids, to a desired range.

In step 930, the HEET fluid projectile is loaded into barrel 102 of propellant driven disrupter 100 for immediate use or stored for "on-demand" use at a later time. The process may be repeated with any number of HEET fluid compositions to generate a variety of HEET projectiles, each optimized for one of a variety of situations, such as those described in step 904, and then stored for later use with directions associated with the projectile, including HEET composition and relevant target disruption applications.

Example 2: HEET Fluids

Highly efficient energy transfer (HEET) fluids can be used in place of water as a projectile to significantly improve the performance of propellant-driven disrupters.

A widely used disrupter in the United States is the Percussion Actuated Non-Electric (PAN) disrupter. The PAN was designed, developed, and characterized at Sandia National Laboratories for the FBI to render safe IEDs. The high grade steel 24" barreled 12 gauge PAN can hold a 140 mL water projectile. Water projectiles are conventionally preferred for general disruption and is the reason propellant-driven disrupters are nicknamed "water cannons." Disrupters can fire solid projectiles or fluids, such as water, to defeat IEDs. The high mass water jets work on IEDs for a longer duration than solid slugs, with a considerable amount of the water's momentum and energy transferred to the bomb. Water can penetrate many kinds of light and medium cased IEDs. The water jet has a large cross sectional area in comparison to a solid projectile and can tear apart a fusing (fuzing) system inside an IED and separate the firing train, all without requiring precise aiming at specific components. In addition, due to the water's low density jet, it produces low impact pressures. The result is a reduced probability of shock initiation and reduced probability of compressively heating the explosives inside an IED. Latent heat is also minimized as the temperature of the projectile remains approximately constant.

A disadvantage of water jets, however, is that they break up quickly through various fluid dynamic stresses. This is significantly overcome by the HEET fluids (210) and systems described herein. For example, HEET fluid 210 may change physically due to shock loading and combustive heating, including a slight increase in viscosity. Accordingly, any of the HEET fluids provided herein may be described as undergoing a chemical change under shock loading. In this manner, HEET fluid jets 300 may form a more sustainable mushroom shaped gelatin-like projectile compared to water jets.

There has been extremely limited examination of fluids other than water for use in disrupters. For example, there are currently no fluids being used to form jets in place of water as a base solution in disrupters to improve target penetration or cavitation. Of note, the composition of HEET fluids may make them relatively insensitive to temperature and they may not freeze like water. Accordingly, any of the methods and systems provided herein are suitable for use in a wide range of temperatures, including common summer temperatures (20° C.-50° C. or greater (e.g., inside a hot car)) and winter temperatures that are below the freezing point of water (less than 0° C., and even arctic temperatures around −40° C. and lower). HEET fluids provided herein are novel at least because several physical properties are integrated to optimize penetration, momentum transfer, and cavitation using a combination of Newtonian fluids, semi-solids and solid particles to create a jet that simultaneously has a fluid and solid behavior. The density gradient of certain HEET mixtures is non-uniform along the projectile column and is demonstrated to improve penetration.

Fluid jets fired from a gun-type disrupter (100) shrink in length in flight due to a reverse velocity gradient. The back of the jet column has a higher velocity than the tip and there is an infinite continuum of velocities within the jet column between the front and rear of the jet. This behavior is henceforward referred to as jet collapse, which is destructive with respect to penetration into a target and will be discussed below. Another destructive aspect of all high speed jets moving through air is atomization, which is the process by which the jet breaks up into droplets. The cause of atomization is due to air ablation, turbulence from shock perturbations and hoop stress. The integration of increasing density, viscosity and surface tension of the jet column reduces jet collapse and atomization. By manipulating the density and viscosity within the projectile column, the claimed invention can generate customizable pressure-time histories and customizable jet profiles in flight. HEET fluids (300) can have a range of jet tip velocities by varying the total mass of the projectile, the cartridge propellant load, and the effective barrel length of the disrupter. HEET fluid jet profiles and pressures can be optimized for penetration and/or cavitation. Conventional fluid projectile disrupter systems do not have this kind of flexibility.

Cartridge-driven disrupters such as the PAN use ammunition similar to that used in guns to propel projectiles. The cartridges (240) vary by manufacturer and caliber. In many cases, the cartridges are specific to the disrupter. Many manufacturers have chosen to use 12 gauge disrupters so cartridge options include commercial-off-the-shelf (COTS) hunting shells, sporting shells, and blank cartridges. This makes the cartridges more affordable and expands the market for the vendor's custom propellant loads. A blank cartridge contains all the components of a bullet except the projectile. A water column or various HEET mixtures (e.g., proximal and distal fluids 214 and 216) can be poured into the disrupter barrel 102 and are driven by the blank cartridge (240) propellant's explosion. The result is the production of a high speed fluid jet possessing a reverse velocity gradient.

Pouring a solution into a disrupter is time consuming and conventionally requires plugging the front and back end of the barrel. The invention provides friction reducing container 202, which may be a barrel liner of paper, wax paper or plastic, or other friction reducing material, or avoids the need of a plug on the back end of the barrel. The friction reducing container 202 allows for pre-manufacture of the HEET fluids which enables the operator to rapidly load a disrupter and easily store the projectiles for the long term. This can be a huge advantage in tactical and dismounted operations. The container or liner 202 can be a sealed tube which prevents leakage and can be rapidly loaded into the disrupter. In addition, the tube protects the barrel against the abrasive nature of some HEET components. Without a friction reducing container, there is a risk of certain HEET fluids (e.g., clay-containing fluid) forming a strong adhesion with, or plug in, the barrel, with resultant adverse consequences when fired. This HEET fluid system advancement is unique; no other projectile containing clay or other materials with high adhesive forces fills an entire barrel of a disrupter, for example.

Depending on the disrupter system, the HEET projectiles 210 are fired either electrically or non-electrically. Electric systems induce a spark into the primer, or the cartridge has an electric match integrated into it. Alternatively, an electromagnetic solenoid is used to drive a firing pin to function a cartridge primer. Non-electric systems such as the PAN often use a firing pin which is actuated by a short pressure pulse of gas generated by shock tube. Shock tube has a thin layer of explosives which, when initiated, causes a shock wave to propagate down the shock tube. The shock tube pressure pulse time of arrival into the breech is very precise and there is very little jitter. An added safety benefit is that shock tube is insensitive to static making it ideal for bomb response operations.

There are many disrupters available on the market that vary in materials and barrel length. In order to save weight and make disrupters easier to carry, manufacturers have used a variety of high strength, light-weight materials such as titanium. In one case, carbon fiber is wrapped around a thin-walled titanium barrel. To further lighten and make disrupters easier to carry and store, there is a growing trend to offer disrupters with barrels less than or equal to half the length of the PAN.

There are undesirable consequences of reducing weight and barrel length, which include loss of accuracy, a significant increase in disrupter recoil and dramatically reduced water jet performance. The water jet is over-driven causing it to collapse and atomize more quickly due to the excessive jet reverse velocity gradient, fluid turbulence and air ablation. Furthermore, the heat of combustion may also evaporate the rear of the jet. HEET fluid projectiles disclosed herein are particularly suited to overcome the limitations of water in short barreled disrupters and greatly improve the performance of full-sized disrupters such as the PAN. HEET fluid jets 300 have greater penetration, volumetric cavitation, higher momentum and energy transfer and can have higher speeds than water jets, while maintaining desired jet characteristics and associated jet parameters. Furthermore, most HEET fluid jets 300 have low impact pressures which are an important consideration when HEET fluid jets are used for general disruption of IEDs.

Water jets are excellent at general IED disruption rather than precision targeting of a component inside an IED. A water jet will likely impact explosives inside a bomb or impart a shock wave to a barrier that propagates through to the explosives on the other side. However, due to the water's low density compared to other projectiles, it produces much lower impact pressures. In comparison, most solid projectiles have densities 2 to 20 times that of water creating significantly higher shock pressures on impact. Solid projectiles are far more effective at penetration than water, but unfortunately may shock initiate explosives found inside of IEDs. Due to the water jet's large volume, mass and expansion, water efficiently transfers its momentum and energy to a target IED and there is a higher likelihood compared to solid projectiles that the water jet will hit an internal component such as wires, power sources and other fuse (fuze) elements. Furthermore, the bomb parts including the explosives are displaced by the water. The displaced material moves at high velocity impacting the fuze and other internal components. The self-destructive internal inertia tears apart the IED's fuzing system and further ruptures the IED's container. HEET fluids 210 combine the advantages of both water and solid projectiles as they have viscoelastic behavior and can have solid particles mixed into a fluid, including a high viscosity fluid such as corn syrup. A series of projectile impact tests on several kinds of impact sensitive and/or thermally sensitive explosives show no detonations or ignitions in the target when fired upon with HEET fluid mixtures. Example target protecting barriers tested are wood or 18 gauge steel barriers. HEET fluids tested against IED surrogates show that the HEET fluids have better disruption capability compared to water. In some cases, the relative impulses of the HEET fluids are equal to explosives-driven water shape charges; this is also unprecedented.

The hydrodynamics of high speed water jets and other Newtonian fluids have been studied extensively. Water and most fluids can be approximated as being incompressible, except under shock loading. A Newtonian fluid has a viscosity that is constant under stress, and there is limited communication of impact between the front and back of a jet because the sides after exiting the barrel are unconfined. Although water jets were used as projectiles prior to the development of the PAN, they were not well understood until the PAN was characterized. A unique characteristic of disrupter-driven jets is they have a reverse velocity gradient. This means the back end of the jet column moves at a faster velocity than the front end of the jet column. CTH hydrocode (Sandia National Laboratories) models show the back of a water column pushes through the middle of the water column causing it to disperse and break up radially due to hoop stress. Water jets also break up due to pressure waves causing turbulence inside the jet and atomization due to air ablation on the front and sides of the jet. These factors have both a negative and positive effect on a target. To a first approximation, the penetration is directly proportional to both the impact pressure and the jet length. As the jet collapses its length is reduced. However, as the jet diameter grows, the likelihood of it hitting objects inside the IED container increases. As air ablation degrades the jet front, the average jet tip velocity increases with respect to distance and time. It may also result in higher velocities post penetration, which is of value when defeating circuits with anti-disturbance triggers.

The duration the jet is acting on a body is directly proportional to jet length and rate of jet collapse and break up. As a result, the duration of time a column of water is doing work on the IED is considerably longer than a solid projectile. It is the fluid properties of water that make it effective at IED disruption. HEET fluids discussed herein are selected based on their rheological properties so as to enhance the desired results for any of a range of situations. HEET fluids are prepared by identifying the critical properties that improve jet penetration. As penetration is directly proportional to jet length it is important to slow jet collapse and reduce atomization and thus preserve the jet column for a longer amount of time. HEET fluids are selected based on their high viscosity, density, and surface tension, thereby reducing atomization and jet collapse.

HEET jets are created by using fluids and semisolids that have higher density, surface tension and viscosity relative to water. Examples of HEET fluids include, but are not limited to, syrups, clays, oils, alcohols (e.g. glycerin) and other organic liquids, liquid mixtures or suspensions. HEET solutions can have viscosities equal to water, or greater than water and up to 100,000 times that of water. HEET solutions can have surface tensions equal to water, or greater than water and up to 7 times that of water. HEET fluids can have specific gravities of 0.5 to 15 times that of water. HEET fluids can also have a specific gravity that is greater than and up to 15 times that of water. Unlike water, the rearward collapse of the HEET jet does not readily disperse the fluid column in front. HEET fluids made from syrups slightly increase their viscosity due to thermal effects in the barrel. The HEET jet length is preserved for a longer period of time than a water jet and instead of breaking up forms a slug. The jet becomes a semi-solid mushroom-shaped projectile which grows in diameter as the rear of the projectile collapses. The result is dramatic cavitation inside targets and associated effective destruction of targets, including IEDs. Higher viscosity HEET materials expand into larger mushroom shaped projectiles thus displacing more volume in a continuous medium. The viscosity of any HEET solution can be altered. For example, adding materials such as sand to syrup can allow for easy adjustment of the mixtures viscosity; the more sand added, the more viscous the mixture becomes. Another option is to dehydrate syrup to increase its viscosity. Studies in this example show a 33% increase in penetration by corn syrup compared to density-matched super saturated water solution. The corn syrup has 1000 times the viscosity of the water solution.

In addition to the jet length dependence, penetration of fluid jets is proportional to the square root of the relative density of the projectile to the target material. Thus the higher effective densities of most HEET fluids should improve penetration. To further increase the effective density of the HEET fluid, denser solid particles can be mixed with the fluid. Examples of solid particles include, but are not limited to, steel shot, lead shot, plastic beads/buffer and micro-particles such as tungsten dust, sand grains, garnet powder and ceramic powder. Water projectiles for short barreled disrupters are typically 2 ounces and for 24" barreled disrupters are typically no more than 4.75 ounces in weight; HEET projectile mass can be higher by a factor of two. HEET solutions weigh up to 5 ounces in short barreled disrupters and up to 9.5 ounces in the PAN. Testing shows increasing density uniformly for fluids of equivalent viscosity did not notably improve penetration with the PAN. Increasing density resulted in approximately a 33% increase in penetration with the TiTAN MB for viscosity-matched solutions. The non-uniform density HEET mixtures show greater increases in penetration compared to uniform mixtures. Higher density HEET jets may cause higher relative impulse on targets, which is also desirable.

An added benefit to using solid particles is abrasion and elastic impacts. Solid particles erode barriers, cut wires, puncture and shatter internal bomb components further into the device; solid particles cannot atomize. As a result, HEET projectiles having both fluid and solid characteristics dramatically improve disruption performance.

To further improve the jet performance and alter jet profile with respect to time, the fluid and particle distribution can be varied in the HEET projectile column inside the disrupter barrel. HEET mixtures can be uniform or non-uniform. For example, a layered mixture and density gradient can be formed by combining syrup, sand and lead shot/tungsten powder. The heavy metals are put in the breech side of the disrupter, and mixed with syrup and sand. The middle of the fluid column is a mixture of syrup and sand, and pure syrup makes up the top layer of the column ending at the muzzle. The composite HEET mixture described above can penetrate a ⅛" mild steel plate, for example. In certain embodiments, for layered HEET columns the rear of the jet where the denser material is located moves relatively slower and thus further reduces the reverse velocity gradient and rate of jet collapse. The lead shot or other solid particles may become trapped in the jet and due to turbulence inside the jet mix more uniformly over time. However, the lower density material may hit the target first thus reducing shock pressures on impact.

Some HEET jets, such as syrup or a syrup-sand mixture, are observed to have an increased jet velocity relative to water. This is partly due to sustained and higher breech pressures in the barrel as the higher density (an increase in inertial mass per unit column length of the projectile) and viscosity resist flow. This higher velocity can be advantageous when disabling a device containing an anti-disturbance switch.

The speed of the projectile can be controlled by varying the cartridge strength or the mass of the HEET fluid column in the barrel. There is an inverse relationship between projectile velocity and the square root of the projectile mass for a given cartridge. It should be noted that, in some examples, the lowering velocity to accomplish barrier penetration is preferred. This is especially the case when the main charge consists of impact sensitive explosives. The impact pressure is proportional to the square of the jet velocity. HEET fluids can penetrate barriers of ⅛" steel at much lower velocities than water jets due to the previously discussed jet preservation resulting in longer impact durations. Thus, despite the higher density of HEET mixtures, low shock pressures can be produced by HEET and they can do equivalent work and impulse as higher velocity projectiles. A reduction in particle velocity (impact velocity) can yield a substantial decrease in shock pressure on an explosive inside the IED. In order to get through the material with a lower shock pressure, HEET fluids increase the duration of loading on the target.

HEET jet penetration relative to water increases up to two times for the full-sized 24" barrel Percussion Actuated Non-Electric (PAN), 10" barrel CarbonFire10 (CF10) and for the 12" barrel TiTAN Main Barrel (MB) disrupters. Furthermore, some HEET fluid jets fired from the TiTAN MB have the capability of penetrating ⅛" thick steel barriers to include punching 1.5" diameter holes in propane tanks. A PAN disrupter driving approximately 140 milliliters of water with an enhanced blank, the strongest cartridge available, cannot penetrate a ⅛" steel plate. HEET jet penetration diameters are larger (up to 1.6×) and when combined with increased penetration, greater volumetric destruction inside an IED is possible compared to water jets. As stated earlier, HEET jets expand in diameter into a more sustained mushroom shaped projectile that has viscoelastic properties. This results in reduced atomization and a slower collapsing of the jet, which make the HEET jets more effective than water at increased stand offs. For example, using the TiTAN MB and the BK90 cartridge (L-Tech Enterprises Inc.), the HEET jet increased penetration by a factor of 3.5 compared to water when the standoff was increased 4 times the nominal distance. Some HEET jets travel at higher post penetration velocities which make them effective at defeating IEDs containing circuits with anti-movement triggers. A TiTAN MB fired HEET jet post-steel barrier penetration is 1.75 times faster than water jets from the PAN within the nominal standoff ranges.

Example 3: HEET Fluid Characterization

Disrupter-driven Highly Efficient Energy Transfer (HEET) fluid jets are more effective than water jets at penetration and cavitation and thus greatly improve disruption of IEDs. We have shown that, in some example tests, penetration is increased up to two times for the full-sized 24" barrel Percussion Actuated Non-Electric (PAN), 10" barrel CarbonFire10 (CF10) and for the 12" barrel TiTAN Main Barrel (MB) disrupters. Furthermore, some HEET fluid jets fired from the TiTAN MB have the capability of penetrating ⅛" thick steel barriers to include punching 1.5" diameter holes in propane tanks. A PAN disrupter driving water with an enhanced blank, the strongest cartridge available, cannot penetrate a ⅛" steel plate. HEET jet hole diameters are larger (up to 1.6 times) and when combined with increased penetration, greater volumetric destruction is possible compared to water jets. HEET jets expand in diameter into a mushroom-shaped projectile that has viscoelastic properties. This results in reduced atomization and a slower collapsing of the jet, increasing duration of impact loading allowing for HEET jets to be effective at penetration at lower impact pressures. Furthermore, HEET jets are more effective than water at increased standoffs. For example, using the TiTAN MB and the BK90 cartridge (L-Tech Enterprises Inc.), the HEET jet had a 3.5 times increase in penetration compared to water when the standoff was increased four times the nominal distance. Some HEET jets travel at higher post penetration velocities which make them effective at defeating Improvised Explosive Devices (IEDs) containing circuits with anti-disturbance triggers. The TiTAN MB fired HEET jet shot through a steel barrier post penetration was 1.75 times faster compared to water jets from the PAN within the nominal standoff ranges.

Short barreled (<18" long) propellant-driven disrupter water jets have limited IED access and disablement capability. Prior testing on the short barreled CF10 and the TiTAN MB disrupters have shown that water jets collapse and atomize quickly. The overall result was a greatly diminished momentum and energy transfer to targets in comparison to standard-sized disrupters (18"-24" barrel lengths) when using water. Another consequence of a smaller water column was that the disrupter standoff must be significantly closer to an IED to be effective. The operational uses for mini-disrupters is limited to the defeat of small-sized, light or medium cased IEDs or exposed IED components at close range. Bomb technicians will most commonly use small barreled disrupters in support of tactical or dismounted operations. Bomb Technicians desire to use mini-disrupters for general bomb response, but the limitations of water jets make them impractical.

HEET jets have significantly improved the standoff, penetration, cavitation, and transfer of momentum and energy to IEDs. Some HEET solution jets fired from the TiTAN MB outperform water jets fired from a standard PAN.

Example 4: Characterization of Preparation and Loading

Certain clay-based HEET mixes should have the foam and cap on the breech end of the projectile. Due to the combustion in the barrel, the rear of the clay-based HEET mixes may be susceptible to excessive heating. There are flammable and volatile oils in the CM-50 de-aired modeling clay that during explosive impact testing may cause partial deflagration reactions with some explosives. This is of particular concern for the CT-B2 HEET fluid projectile when used against IEDs containing thermally sensitive propellants such as black or smokeless powders. If the 1" foam plug is not used in the 24" barrel PAN disrupter, a rarefaction pressure wave spike in the breech may cause damage to the firing pin. The foam plug can attenuate the pressure spike. For certain HEET fluid projectiles containing lead or tungsten, the BK110 blank or CarbonFire Ultra Velocity blank cartridges should not be used. These cartridge shells ("cartridge" is an embodiment of explosive cartridge 240) may jam in the breech and may damage the firing pin.

Preparation and load procedures: 1. Primary Method: Cut the bore tube ("bore tube" is an embodiment of friction reducing container 202) (Visipak part no. 043942) the proper length. a. When using the TiTAN® disrupter main barrel (an example of barrel 102) cut the bore tube 9½" long. b. When using the CarbonFire® disrupter main barrel (another example of barrel 102) cut the bore tube 7½" long. Trim the cap shoulder down to approximately the same diameter as the tube. (FIG. 11, panel A). c. Secondary Method: Cut ¼ inch longer than the length of the bore ("bore" is an embodiment of barrel 102) once the cartridge is loaded. This ¼ inch allows the tube to project beyond the muzzle for the tape bridle to secure the tube ("tube" is an embodiment of friction reducing container 202) into the bore. Load the tube into the chamber end of the disrupter then place cartridge into the chamber. Secure forward end of tube with tape bridle.

Figure 11:
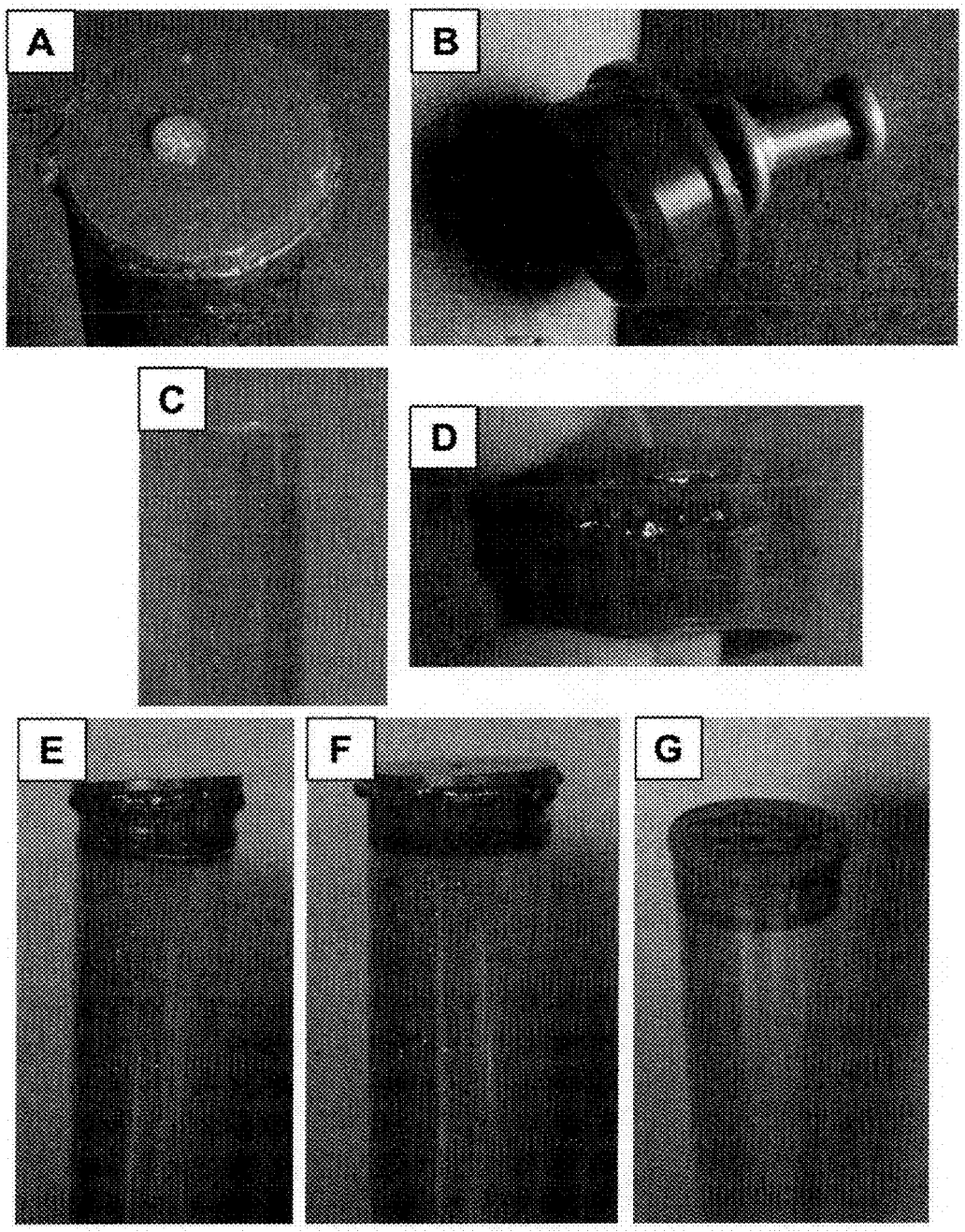
FIG. 11 panels A through G are photographs of an exemplary process for making HEET projectiles. Panel A shows a cap for a friction reducing container of the HEET fluid projectile. Panel B shows a vent hole made in the cap. Panel C shows a friction reducing container partially filled with a HEET fluid. Panel D shows assembly of the cap with adhesive layer. Panels E-G illustrate capping of the friction reducing container containing a HEET fluid, and sealing of the vent hole in the cap, thereby minimizing or avoiding air pockets in the lumen.

2. Using a thumb tack make a vent hole in the tube cap ("tube cap" is an embodiment of cap 220) (Visipak part no. 561895). (FIG. 11, panel B)

3. Fill the tube completely. Try not to get the fluid onto the uppermost edge of the tube. (FIG. 11, panel C) This allows a dry area for the LOCTITE® Super Glue Gel to adhere.

4. Apply a liberal coating of LOCTITE® Super Glue Gel (an example of adhesive 224) to the tube cap where the body and shoulder meet. (FIG. 11, panel D)

5. Place the prepared tube cap onto the open end of the filled bore tube. (FIG. 11, panel E) Fully seat the cap onto the tube (FIG. 11, panel F) and use the excess LOCTITE® Super Glue Gel to seal the vent hole made with the thumb tack. (FIG. 11, panel G)

Figure 12:
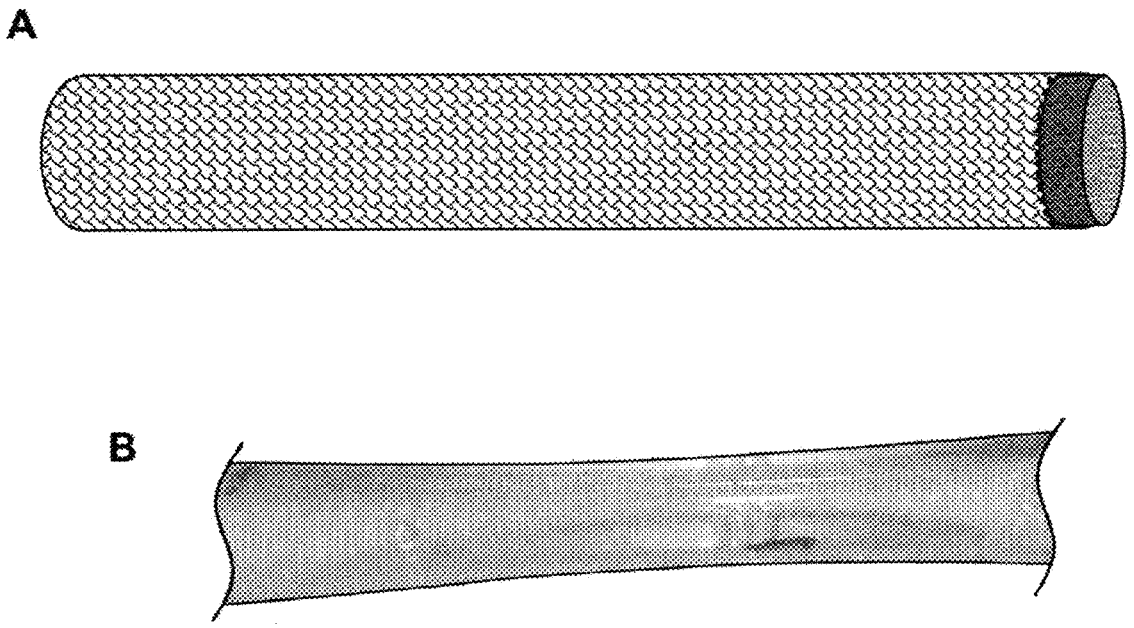
FIG. 12, panel A, is a capped HEET fluid projectile coated with a sealant to seal pores in the container.

6. Once the LOCTITE® Super Glue Gel is dry, confirm the seal is holding. Invert the tube to check for leaks. If there are no leaks then multiple thin coats of spray paint (an example of coating 227) should be applied to the tube. (FIG. 12, panel A) This seals the pores of the plastic tube to help prevent the loss of moisture from the projectile fluid. Should this not be done a deformation of the tube may occur as moisture leaks through the pores. (FIG. 12, panel B)

7. For syrup (SY) based HEET fluid mixtures, thickening of the syrup will occur over time. The HEET fluid is still usable and testing has shown this to improve the performance of the HEET fluid mixture. Should this effect be desired the process may be hastened by heating syrup to boil for 30-45 seconds using a microwave to remove some water content. Allow the syrup to cool enough to handle safely prior to mixing or pouring into the visipak tube.

Figure 13:
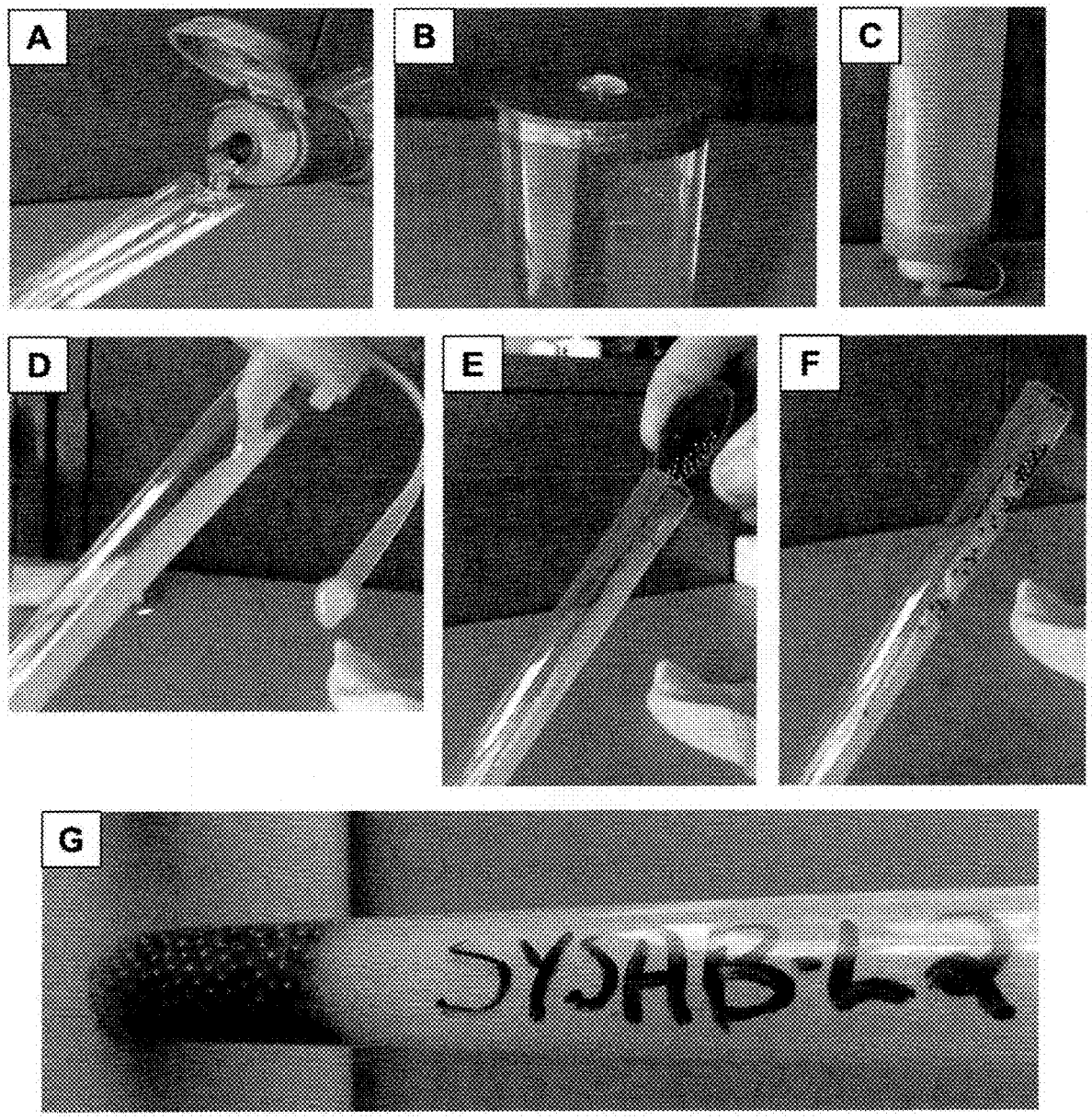
FIG. 13 panels A through G are photographs illustrating steps of an exemplary process for filling a projectile's friction reducing container with a HEET fluid (e.g., corn syrup or a mixture of corn syrup, sand, and lead shot). Panel A shows filling of the friction reducing container with a HEET fluid that is corn syrup. Panel B is a capped syrup-containing friction reducing container, wherein fluid is allowed to escape a vent hole in the cap during filling to minimize or avoid unwanted air pockets. The vent hole can be subsequently sealed. Panels C and D show a filling of a friction reducing container with a HEET fluid that is a syrup and sand mixture. Panels E-G show filling of the friction reducing container with a HEET fluid that is a syrup-sand mixture with lead shot.

HEET Fluid Mixtures:

Syrup (SY) HEET fluid a. With the proper length bore tube; that has the factory seal on one end, fill the tube with Karo Light Corn syrup. Tilt the tube slightly and allow the syrup to flow down the inside of the tube. (FIG. 13, panel A) This helps in the prevention of air bubbles in the syrup. b. Once the tube is filled secure the lid onto the open tube end using the LOCTITE® Super Glue Gel. Have a vent hole in the lid to allow trapped air and excess syrup to escape. Seal the vent hole. (FIG. 13, panel B)

Syrup and Sand (SYSA) HEET fluid a. Mixture is a 50/50 mix by weight. Weigh out at least 4 ounces of each product to ensure there is enough for use in a short barreled disrupter. Long barrels will require more materials to fill the full length. b. Mix the syrup and kiln dried fine grain hobby sand (SYSA) until the sand is kneaded into the syrup. There should be no dry sand if properly mixed (sand is an example of solid particle 218). The sand will settle out of the syrup if allowed. Prior to filling the bore tube agitate the mixture. Also tilt the opening down and allow more of the sand to settle down prior to filling the bore tube so more of the sand will go into the bore tube. (FIG. 13, panel C) c. With the proper length bore tube; that has the factory seal on one end, fill the tube with the SYSA mixture. Tilt the tube slightly and allow the SYSA to flow down the inside of the tube. This helps in the prevention of air bubbles in the SYSA. (FIG. 13, panel D) d. Once the tube is filled place the lid (an example of cap 220) onto the open tube. Settling of the SYSA mix will occur and if allowed to sit upright 24 hours the excess SY will separate and float to the top. Excess SY may be poured out of the tube and SYSA added to fill that void. e. Once the tube is filled and further manipulation of the HEET fluid is not planned; secure the lid onto the open tube end using the LOCTITE® Super Glue Gel. Have a vent hole in the lid to allow trapped air and excess syrup to escape. Be sure to seal the vent hole also.

Syrup, Sand and Lead Shot (SYSAL-B2) HEET a. The syrup and sand mixture is a 50/50 mix by weight. Weigh out at least 4 ounces of each product to ensure there is enough for use in a short barreled disrupter. Use 2 ounces of #6 lead Antimony Magnum (uncoated) shot. Long barrels will require more SYSA materials to fill the full length. b. Mix the syrup and sand (SYSA) until the sand is kneaded into the syrup. There should be no dry sand if properly mixed. The sand will settle out of the syrup if allowed. Prior to filling the bore tube agitate the mixture. Also pre-stage the opening of the container down to allow more of the sand to get into the bore tube. (FIG. 13, panel C) c. With the proper length bore tube; that has the factory seal on one end, fill the tube with the SYSA mixture. Tilt the tube slightly and allow the SYSA to flow down the inside of the tube. Once there is some of the SYSA mixture down the inside and bottom of the tube slowly pour in a little of the lead shot (lead shot is an example of solid particle 218). This helps in the prevention of air bubbles in the SYSA. Now pour in a little more of the SYSA to assist the lead shot flow down the tube. Alternate between some lead shot and some SYSA until all the lead shot is in the bore tube. Then top off the bore tube with SYSA mix. (FIG. 13, panels D, E, and F) d. Once the tube is filled place the lid onto the open tube. Settling of the SYSA mix will occur and if allowed to sit upright 24 hours the excess SY will separate and float to the top. For additional mass the excess SY may be poured out of the tube and SYSA added to fill that void. e. Once the tube is filled and further manipulation of the HEET fluid is not planned; secure the lid onto the open tube end. Have a vent hole, thumb tack prick, in the lid to allow trapped air and excess syrup to escape. The SYSA mixture may plug the vent, clear with thumb tack as needed. A seal for the vent hole can be a small piece of clay. f. Ensure that the end of the bore tube containing the lead shot is placed adjacent to the cartridge or chamber end of the disrupter bore. (FIG. 13, panel G). When using the primary loading method the tube should be inverted so the lead can settle onto the capped end of the tube.

Clay HEET a. From a block of CM-50 de-aired modeling clay cut multiple small pieces of clay. These should be approximately half to ¾ marble sized. (FIG. 14, panel A) b. With the proper length bore tube start by dropping a clay piece into the bore tube with one open end on a solid surface. Tamp the clay into the bore tube. Be careful when tamping to insure that the tube is not expanding. Any expansion can cause problems when inserting tube into the disrupter bore. Add and tamp the clay pieces individually. Attempt to have no voids or air pockets. Tamp the clay to the consistency as it was in the original package.

Clay and Lead Shot (CL-B2) HEET a. From a block of clay cut multiple small pieces of clay. These should be approximately half marble sized. b. Weigh out 2 ounces of clay and add 2 ounces of #6 lead shot. (FIG. 14, panels A and B) Knead these materials together until the lead appears to be somewhat uniform through the clay. (FIG. 14, panel C) Break this into small pieces of clay/lead mix. c. With the proper length bore tube start by dropping a clay/lead piece into the bore tube with one open end on a solid surface. Tamp the clay/lead into the bore tube. Add and tamp the clay/lead pieces individually. Attempt to have no voids or air pockets. Tamp the clay/lead to the consistency as it was in the original package. d. Once all of the clay/lead mix has been packed into the bore tube continue to fill with clay. Ensure that the end with the clay/lead mix is placed into the disrupter bore so that it is adjacent the cartridge or chamber end.

Figure 14:
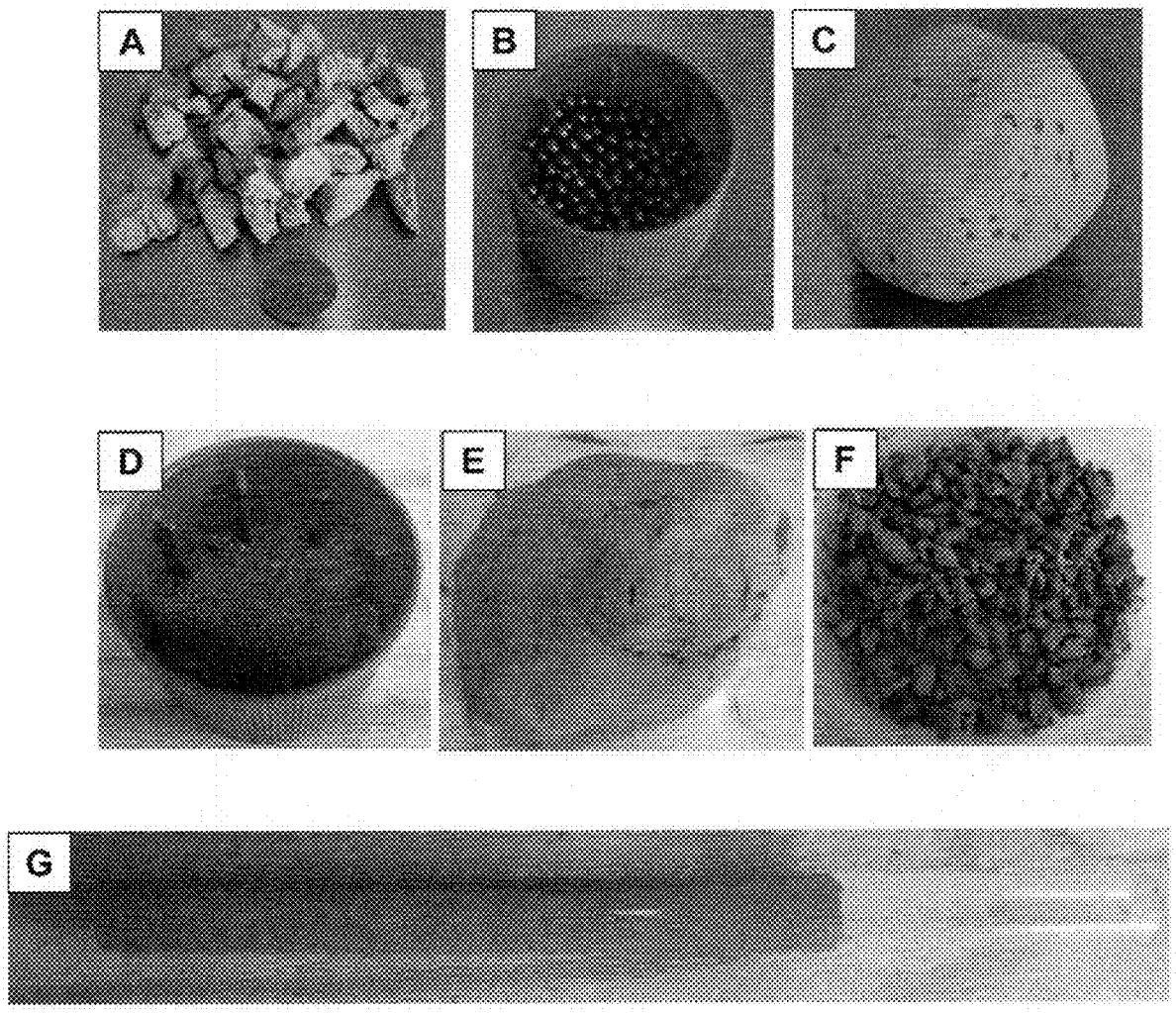
FIG. 14A through G are photographs illustrating steps of an exemplary process for preparing a HEET fluid that includes clay. Panel A is pieces of CM-50 clay. Panel B is lead shot. Panel C is a mixture of clay and lead shot. Panel D is tungsten powder. Panel E is clay kneaded together tungsten powder. Panel F is the kneaded clay-tungsten mixture broken into many pieces. Panel G is a friction reducing container of a HEET fluid projectile partially filled with a HEET fluid that is the clay-tungsten mixture.

Clay and Tungsten (CT-B2) HEET a. From a block of clay cut multiple small pieces of clay. These should be approximately half marble sized. b. Weigh out 2 ounces of clay and add to that 2 ounces of 30 micron tungsten powder (an example of solid particle 218). (FIG. 14, panels D and E) Knead these materials together until the lead appears to be uniform through the clay. (FIG. 14, panel E) Break this into small pieces of clay/tungsten mix (FIG. 14, panel F). c. With the proper length bore tube start by dropping a clay/tungsten piece into the bore tube with one open end on a solid surface. Tamp the clay/tungsten into the bore tube (FIG. 14, panel G). Add and tamp the clay/tungsten pieces individually. Attempt to have no voids or air pockets. Tamp the clay/tungsten to the consistency as it was in the original package. d. Once all of the clay/tungsten mix has been packed into the bore tube continue to fill with clay. Ensure that the end with the clay/tungsten mix is placed into the disrupter bore so that it is adjacent the cartridge or chamber end. Complete by tamping clay into tube. Be sure tungsten end is loaded to cartridge side.

Figure 15:
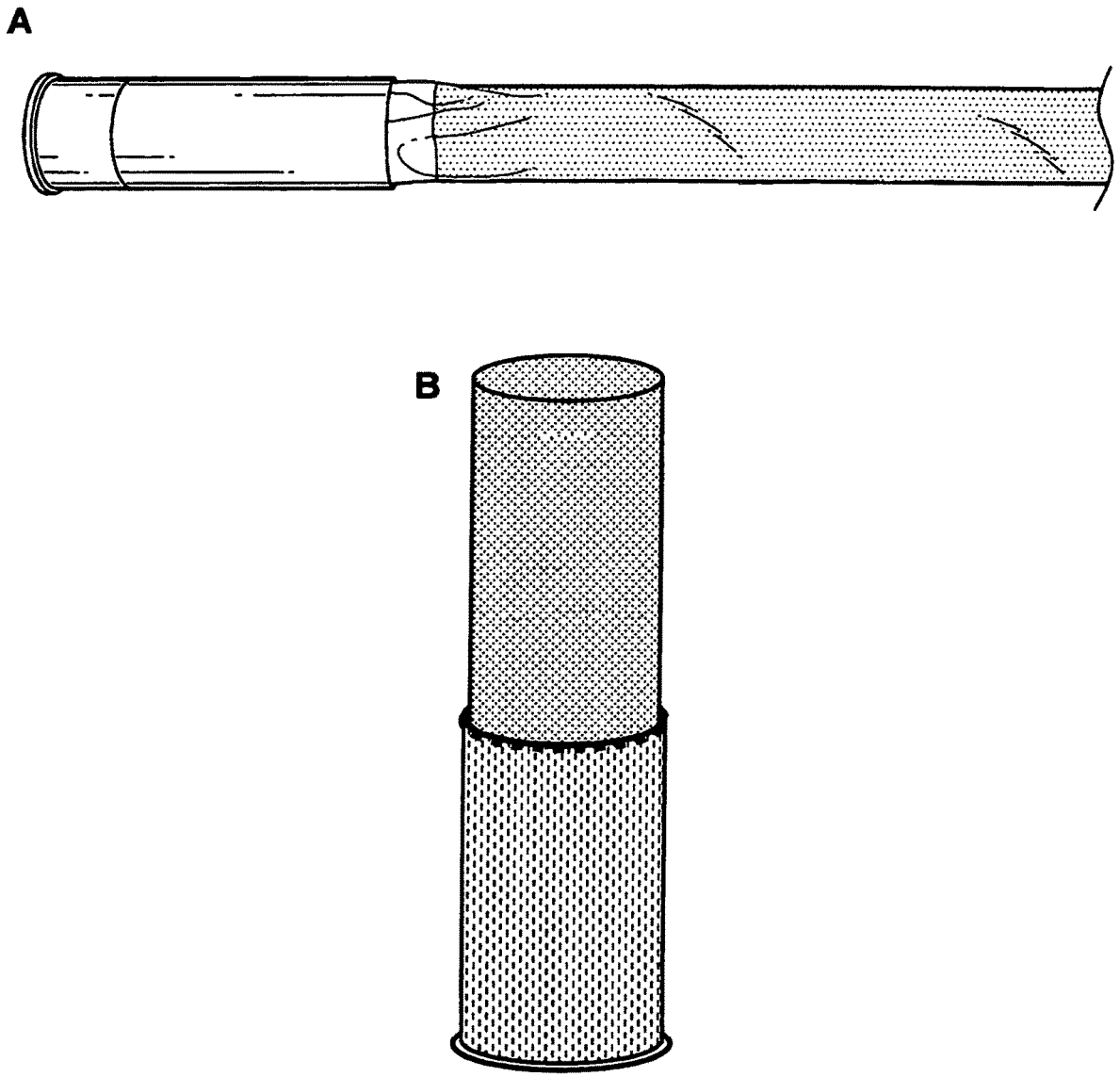
FIG. 15 panel A is a HEET fluid projectile connected to an explosive cartridge (e.g., blank shotgun shell) via plastic wrapping. Panel B is a HEET projectile connected to an explosive cartridge with an adhesive layer.

Preparing the cartridge and projectile for use: a. Using the primary method. (i) When using the TiTAN® disrupter main barrel secure a capped end of the tube (e.g., the proximal end of the projectile) to the cartridge using one wrap of packing tape. (FIG. 15, panel A) Cartridge/projectile is now ready to load into the disrupter. Do Not Use BK 110 or E-Blank when utilizing Lead or Tungsten in HEET fluid mixture. (ii) When using the CarbonFire® disrupter main barrel place capped end into the neck of the cartridge case. A little LOCTITE® Super Glue Gel may be applied to the outside of the tube to secure the tube and cartridge union. (FIG. 15, panel B) Cartridge/projectile is now ready to load into the disrupter. Do Not Use Ultra Velocity when utilizing Lead or Tungsten in HEET mixture. b. Secondary Method: Cut' inch longer than the length of the bore once the cartridge is loaded. This' inch allows the tube to project beyond the muzzle for the tape bridle to secure the tube into the bore. Load the projectile (an embodiment of projectile 200) into the chamber end of the disrupter then place cartridge into the chamber. Secure forward end of projectile with tape bridle.

Example 5

Example experimental conditions and results (TABLEs 1 and 2) for testing disablement capability and impact dynamics on explosives. All tests in this example have a projectile is filled with a HEET fluid(s) as described and certain parameters are recorded, such as the projectile weight. The projectile is loaded into a propellant driven disrupter and the disrupter is placed at stand-off distance from the target.

Description of Test Objectives: The example HEET fluid tests examine operational scenarios, relative impulse measurements, disablement capability and impact dynamics on explosives. The tests also examine the hydrodynamics of HEET and the contributions of density and viscosity to the penetration and work done on a target. Also assessed is disablement capability data and disrupter velocity data.

Materials: Targets (examples of target 600): Quadcan™; 8 Quart, Steel, Presto Pressure cooker with vibratory circuit; Ammo can with vibratory circuit; 1 ftx 1 ftx 1 ft wood box with vibratory circuit; fabric bag containing rags, 2 PVC pipe bombs and vibratory circuit; PVC caps filled with explosives, to barriers 5/16 plywood or 0.04 steel plate.

Projectiles (example of projectile 200): HEET fluids tested are SY, SYSA, SYSAL, C, CL, CT, blackstrap molasses, and light molasses. Legend for HEET fluid descriptions: "Sy" refers to corn syrup; "Sa" refers to sand; "C" refers to CM50 clay; "L" refers to lead shot; "H" refers to uniform mixture; "B" refers to the breech end; "H2O" refers to the fluid in the projectile being water.

Disrupters (examples of disrupter 100): PAN-6 total (1 in foam spacer in breech required for each shot); CF10-4 total; TiTAN MB-7 total Ammunition (examples of cartridge 240, together with explosives below): BK40, BK90, BK110 from LTech Enterprises LLC; EODXP Med, High, Ultra from Concept Development Corp.

Explosives: GOEX FFFg black powder; Hi Skor 700X double based smokeless powder; Tannerite; potassium chlorate and baby oil; J-tek7 electric match MJG Technologies.

TABLE 1 summarizes relative impulse and laminar assessment data against Quadcan.

Test Series: Hydrodynamic Properties of HEET Jets.

Description of Set Up, Test Method, and Objectives: Examine the effects of density and viscosity on jet profile and penetration. Wood baffle tests is conducted using 0.5" thick 4 ply plywood panels. In addition high speed video is used to examine jets fired with a 6' separation between muzzle and barrier. Garden stakes is placed in the background every 12". The rate of jet shrinkage, profile and velocity is examined. HEET Jets is fired from a PAN disrupter. Karo syrup has a viscosity of 2,000-3,000 CP, specific gravity 1.43. Blackstrap Molasses has a viscosity of 5,000-10,000 CP, specific gravity 1.49. Results are summarized in TABLE 2.

Test Series: Disrupter Impact Effects on Explosives.

Description of Set Up, Test Method, and Objectives: For each HEET (6 types) shoot at each explosive (4 types). Projectiles impact the explosive filler through either 5/16" thick plywood or 0.040" mild steel barriers.

Test Series: Disrupter Impact Effects on Explosives—Clay Based Projectile Investigation.

Description of Set Up, Test Method, and Objectives: Investigation into initiation phenomena caused by clay based projectiles using explosive witness materials with 5/16" plywood or 0.040" steel barriers.

Test Series: Disrupter Impact Effects on Explosives—Increased Stand-Off.

Description of Set Up, Test Method, and Objectives: Projectiles impact explosive witness materials through 5/16" thick plywood or 0.040" thick mild steel barriers.

Example 6

Additional example experimental conditions and results (TABLEs 3-8) for testing disablement capability and impact dynamics on explosives. In all cases of Example 5, the projectile is filled with a HEET fluid(s) as described and certain parameters are recorded, such as the projectile weight. The projectile is loaded into a propellant driven disrupter and the disrupter is placed at stand-off distance (310) from the target. The target is a set of wood panels held together tightly. The tests measure, for example, the number of wood panels penetrated by the propelled HEET fluid and other parameters of the resulting damage.

TABLE 3 summarizes results for test series corresponding to Comparative Penetration of various HEET Mixtures loaded in Plastic Tubes on Laminar 0.5" Plywood Sheets with 3" Spacing—TiTAN MB Disrupter at 3" Stand-off.

TABLE 4 summarizes results for test series corresponding to Penetration Profile—Layered Gypsum Board Block Target—0.375" Thick Layers.

Velocities of the Jet Tip for HEET fired from a TiTAN MB Disrupter are measured.

TABLE 5 summarizes results for test series corresponding to Comparative Penetration of various HEET Mixtures loaded in Plastic Tubes on Laminar 0.5" Plywood Sheets with 3" Spacing—TiTAN MB Disrupter at 12" Stand-off.

TABLE 6 summarizes results for test series corresponding to Comparative Penetration of various HEET Mixtures loaded in Plastic Tubes on Laminar 0.5" Plywood Sheets with 3" Spacing—Carbon Fire 10 Disrupter.

TABLE 7 summarizes results for test series corresponding to Comparative Penetration of Water Jets on Laminar 0.5" Plywood Sheets with 3" Spacing.

TABLE 8 summarizes results for test series corresponding to Comparative Penetration of Various Projectiles on Laminar 0.5" Plywood Sheets with 3" Spacing-PAN Disrupter.

Statements Regarding Incorporation by Reference and Variations

All references throughout this application, for example patent documents including issued or granted patents or equivalents; patent application publications; and non-patent literature documents or other source material are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention. The specific embodiments provided herein are examples of useful embodiments of the present invention and it will be apparent to one skilled in the art that the present invention may be carried out using a large number of variations of the devices, device components, methods and steps set forth in the present description. As will be obvious to one of skill in the art, methods and devices useful for the present embodiments can include a large number of optional device components, compositions, materials, combinations and processing elements and steps.

Every device, system, combination of components or method described or exemplified herein can be used to practice the invention, unless otherwise stated.

When a group of substituents is disclosed herein, it is understood that all individual members of that group and all subgroups, including any device components, combinations, materials and/or compositions of the group members, are disclosed separately. When a Markush group or other grouping is used herein, all individual members of the group and all combinations and subcombinations possible of the group are intended to be individually included in the disclosure.

Whenever a range is given in the specification, for example, a number range, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein to indicate the state of the art as of their publication or filing date and it is intended that this information can be employed herein, if needed, to exclude specific embodiments that are in the prior art.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements and/or limitation or limitations, which are not specifically disclosed herein.

One of ordinary skill in the art will appreciate that compositions, materials, components, methods and/or processing steps other than those specifically exemplified can be employed in the practice of the invention without resort to undue experimentation. All art-known functional equivalents, of any such compositions, materials, components, methods and/or processing steps are intended to be included in this invention. The terms and expressions which have been employed are used as terms of description and not of limitation, and there is no intention in the use of such terms and expressions of excluding any equivalents of the features shown and described or portions thereof, but it is recognized that various modifications are within the scope of the invention claimed. Thus, it should be understood that although the present invention has been specifically disclosed by exemplary embodiments and optional features, modification and variation of the concepts herein disclosed may be resorted to by those skilled in the art, and that such modifications and variations are considered to be within the scope of this invention as defined by the appended claims.

It must be noted that as used herein and in the appended claims, the singular forms "a", "an", and "the" include plural reference unless the context clearly dictates otherwise. Thus, for example, reference to "a layer" includes a plurality of layers and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably.

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described.

TABLE 1

Quadcan: Relative Impulse and laminar assessment

| | | Stand- | HEET | | | Laminar Penetration |
|---|---|---|---|---|---|---|
| Shot No. | Disrupter | off (inches) | HEET Type | Mass (oz) | Cartridge | Exterior (H × W) |
| 1 | TiTAN MB | 3 | Sy | 2.9 | BK90 | 3.5" × 5" |
| 2 | TiTAN MB | 3 | Sy | 2.9 | BK90 | 2.5" × 2.125" |
| 3 | TiTAN MB | 3 | SySa | 3.8 | BK90 | 3.75" × 3.125" |
| 4 | TiTAN MB | 3 | SySa | 3.7 | BK90 | 2.875" × 2.5" |
| 5 | TiTAN MB | 3 | SySaL | 5.3 | BK90 | 2.25" × 2.125" |
| 6 | TiTAN MB | 3 | SySaL | 5.4 | BK90 | 2.25" × 2.125" |
| 7 | TiTAN MB | 3 | C | 3.2 | BK90 | 5.5" × 3.675" |
| 8 | TiTAN MB | 3 | C | 3.2 | BK90 | 2.875" × 2.25" |
| 9 | TiTAN MB | 3 | CL | 4.9 | BK90 | 3.75" × 3.0" |
| 10 | TiTAN MB | 3 | CL | 4.9 | BK90 | 3.5" × 3.25" |
| 11 | TiTAN MB | 3 | CT | 4.9 | BK90 | 2.5" × 2.375" |
| 12 | TiTAN MB | 3 | CT | 4.9 | BK90 | 2.375" × 2.0" |
| 13 | PAN | 6 | Sy | 6.7 | BK90 | 1.25" × 1.5" |
| 14 | PAN | 6 | Sy | 6.8 | BK90 | 1.125" × 1.375" |
| 15 | PAN | 6 | SySa | 8.4 | BK90 | 0.75" × 0.625" |
| 16 | PAN | 6 | SySa | 9 | BK90 | 1.25" × 1.125" |

TABLE 1-continued

| Quadcan: Relative Impulse and laminar assessment | | | | | | |
|---|---|---|---|---|---|---|
| | | | | Momentum Tranfer | | |
| | Laminar Penetration | | | Target | Target | |
| Shot No. | Panel 1 (H × W) | Panel 2 (H × W) | Panel 3 (H × W) | Distance (feet) | Velocity (ft/s) | Momentum (slug · ft/s) |
| 1 | 1.875" × 2.375" | 1.625" × 1.50" | Top Shear | 20.3 | 40.7 | 10.1 |
| 2 | 1.75" × 1.875" | 1.625" × 2.0" | Buldged | 19.5 | 39.1 | 9.7 |
| 3 | 2" × 2.675" | 1.5" × 1.5" | Top Shear | 20.8 | 41.7 | 10.4 |
| 4 | 1.875" × 2.125" | 1.75" × 1.625" | Small Shear | 20.2 | 40.5 | 10.1 |
| 5 | 1.5" × 1.875" | 1.375" × 1.875" | 1.5" × 0.625" | 23.1 | 46.3 | 11.5 |
| 6 | 1.375" × 1.56" | 1.5" × 1.5" | 1.25" × 1.125" | 27.7 | 55.6 | 13.8 |
| 7 | 1.875" × 2.75" | 2.0" × 1.125" | Horizontal Slit | 20.8 | 41.7 | 10.3 |
| 8 | 2.125" × 2.375" | 2.125" × 2.0" | Small Shear | 20.0 | 40.1 | 10.0 |
| 9 | 1.875" × 1.625" | 1.75" × 1.5" | 1.0" × 0.5" | 26.6 | 53.4 | 13.2 |
| 10 | 2.5" × 1.625" | 2.75" × 2.25" | Small Buldge | 27.5 | 55.2 | 13.7 |
| 11 | 2.125" × 1.375" | 1.75" × 2.0" | 1.0" × 1.5" | 24.9 | 50.0 | 12.4 |
| 12 | 2.375" × 2.0" | 2.25" × 1.375" | 0.625" × 1.75" | 24.8 | 49.8 | 12.4 |
| 13 | 1.125" × 10" | 1.0" × 1.0" | 0.75" × 0.75" | 29.4 | 59.0 | 14.6 |
| 14 | 1.0" × 1.0" | 1.0" × 1.0" | 1.062" × 1.062" | 28.2 | 56.6 | 14.1 |
| 15 | 0.625" × 0.625" | 0.625" × 1.0" | 1.0" × 0.375" | 31.5 | 63.2 | 15.7 |
| 16 | 1.5" × 1.0" | 0.875" × 1.375" | 1.375" × 1.25" | 32.1 | 64.4 | 16.0 |

APPENDIX OF TABLES

TABLE 2

| Hydrodynamic Properties of HEET Fluid Jets | | | | | | | | | |
|---|---|---|---|---|---|---|---|---|---|
| Shot No. | Disrupter | Stand-off (inches) | HEET Type | HEET Mass (oz) | Catridge | Panels Perforated | Panels Fractured | Max Hole Dimensions | Max Hole Panel |
| 1 | TiTAN MB | 3 | Sy | 2.84 | BK90 | 4 | 1 | 2.5" × 2.75" | 4 |
| 2 | TiTAN MB | 3 | BM | 2.86 | BK90 | 5 | 1 | 2.5" × 2.5" | 3 |
| 3 | TiTAN MB | 3 | Caramel | 3.02 | BK90 | 4 | 1 | 3.75" × 3.25" | 3 |
| 4 | TiTAN MB | 3 | $H_2O$ | 2.14 | BK90 | 4 | 0 | 3.5" × 3.0" | 3 |
| 5 | TiTAN MB | 3 | Heavy $H_2O$ | 2.76 | BK90 | 4 | 1 | 2.75" × 3.5" | 3 |
| 6 | TiTAN MB | 3 | Sy | 2.78 | BK90 | 4 | 1 | 2.5" × 3.0" | 4 |
| 7 | TiTAN MB | 3 | $H_2O$ | 2.06 | BK90 | 4 | 0 | 3.0" × 3.25" | 3 |
| 8 | TiTAN MB | 3 | DSy | 2.88 | BK90 | 4 | 1 | 3.25" × 3.5 | 4 |
| 9 | TiTAN MB | 3 | Heavy $H_2O$ | 2.74 | BK90 | 4 | 1 | 4.25" × 2.75" | 3 |
| 10 | TiTAN MB | 3 | Sy | 2.82 | BK90 | 5 | 1 | 3.0" × 2.75" | 4 |
| 11 | TiTAN MB | 3 | Heavy $H_2O$ | 2.80 | BK90 | 4 | 1 | 3.75" × 2.25" | 3 |
| 12 | TiTAN MB | 3 | Sy | 2.86 | BK90 | 4 | 0 | 2.5" × 2.5" | 3 |
| 13 | TiTAN MB | 3 | $H_2O$ | 2.02 | BK90 | 4 | 0 | 3.5" × 3.25" | 3 |
| 14 | TiTAN MB | 3 | Viscous $H_2O$ | 2.04 | BK90 | 4 | 0 | 4.25" × 3.0" | 3 |
| 15 | PAN | 6 | Sy | 6.78 | BK90 | 12 | 0 | 1.75" × 1.75" | 6 |
| 16 | PAN | 6 | Heavy $H_2O$ | 6.8 | BK90 | 9 | 0 | 3.25" × 1.78" | 5 |
| 17 | PAN | 60 | Sy | 6.8 | BK90 | 4 | 1 | 3.0" × 3.25" | 1 |
| 18 | TiTAN MB | 12 | Sy | 2.84 | BK90 | 3 | 0 | 3.5" × 3.5" | 2 |
| 19 | PAN | 60 | Heavy $H_2O$ | 6.80 | BK90 | 1 | 2 | 4.5" × 2.5" | 1 |
| 20 | TiTAN MB | 12 | Heavy $H_2O$ | 2.84 | BK90 | 3 | 0 | 4.0" × 4.0" | 1 |
| 21 | PAN | 60 | Heavy $H_2O$ | 2.96 | BK90 | 4 | 0 | 3.5" × 4.0" | 1 |
| 22 | PAN | 60 | Sy | 2.98 | BK90 | 3 | 1 | 3.75" × 4.0" | 1 |
| 23 | PAN | 60 | Heavy $H_2O$ | 4.82 | BK90 | 4 | 0 | 5.5" × 4.25" | 1 |
| 24 | PAN | 60 | Sy | 4.66 | BK90 | 4 | 0 | 5.0" × 6.0" | 1 |
| 25 | PAN | 60 | $H_2O$ | 4.73 | BK90 | 9 | 0 | 2.5" × 2.25" | 8 |

TABLE 3

Comparative Penetration of various HEET Mixtures loaded in Plastic Tubes on Laminar 0.5" Plywood Sheets with 3" Spacing and TiTAN MB Disrupter at 3" Stand-off

| Test No. | Disrupter | Cartridge | Projectile Mixture | Projectile Weight (oz.) | Disrupter Stand-Off (in) | Panels Perforated | Panels Fractured | Max Hole Diameter (in) | Max Hole Panel |
|---|---|---|---|---|---|---|---|---|---|
| 1 | TiTAN MB | BK90 | SySa | 3.8 | 3 | 10 | 0 | 2.9 | 10 |
| 2 | TiTAN MB | BK90 | Sy | 2.9 | 3 | 5 | 1 | 4.7 | 4 |
| 3 | TiTAN MB | BK90 | SyL-B2 | 4.7 | 3 | 5 | 0 | 3.9 | 1, 2, 3, and 4 |
| 4 | TiTAN MB | BK90 | SySaL-B2 | 5.4 | 3 | 11 | 0 | 2.8 | 7 |
| 5 | TiTAN MB | BK90 | SyT-B2 | 4.8 | 3 | 10 | 1 | 2.9 | 8 |
| 6 | TiTAN MB | BK90 | SySaT-B2 | 5.6 | 3 | 10 | 0 | 2.5 | 4 |
| 7 | TiTAN MB | BK90 | CL-H1.5 | 4.5 | 3 | 5 | 0 | 3.3 | 3 |
| 8 | TiTAN MB | BK90 | CL-B2 | 5.3 | 3 | 7 | 1 | 3.6 | 5 |
| 9 | TiTAN MB | BK90 | CL-H2 | 4.9 | 3 | 5 | 1 | 4.3 | 3 |
| 10 | TiTAN MB | BK90 | C | 3.1 | 3 | 6 | 1 | 3.6 | 5 |
| 11 | TiTAN MB | BK90 | CT-H1 | 3.9 | 3 | 5 | 1 | 3.1 | 3 |
| 12 | TiTAN MB | BK90 | CT-H2 | 5.0 | 3 | 5 | 1 | 3.9 | 3 |
| 13 | TiTAN MB | BK90 | CT-B2 | 5.0 | 3 | 6 | 1 | 4.3 | 4 |
| 14 | TiTAN MB | BK90 | SySa-B2 | 5.5 | 3 | 10 | 1 | 2.4 | 5 |
| 15 | TiTAN MB | BK40 | Sy | 2.9 | 3 | 6 | 1 | 1.8 | 3 |
| 16 | TiTAN MB | BK110 | Sy | 2.9 | 3 | 5 | 1 | 4.0 | 4 |
| 17 | TiTAN MB | BK40 | SySa | 3.9 | 3 | 4 | 1 | 3.8 | 3 |
| 18 | TiTAN MB | BK110 | SySa | 3.9 | 3 | 5 | 2 | 4.1 | 4 |
| 19 | TiTAN MB | BK40 | SySaL-B2 | 5.4 | 3 | 8 | 0 | 2.5 | 4 |
| 20 | TiTAN MB | BK40 | C | 3.2 | 3 | 3 | 2 | 3.7 | 3 |
| 21 | TiTAN MB | BK110 | C | 3.5 | 3 | 5 | 0 | 4.0 | 3 |
| 22 | TiTAN MB | BK40 | CL-B2 | 4.9 | 3 | 6 | 1 | 2.8 | 2 |
| 23 | TiTAN MB | BK40 | CT-B2 | 5.1 | 3 | 4 | 1 | 2.5 | 2 |

TABLE 4

Penetration Against Layered Gypsum Board Block Target (0.375" Thick Layers)

| Test No. | Disrupter | Cartridge | Projectile Mixture | Projectile Weight (oz.) | Disrupter Stand-Off (in) | Panels Perforated | Panels Damaged |
|---|---|---|---|---|---|---|---|
| 1 | TiTAN MB | BK40 | Sy | 2.9 | 3 | 7 | 4 |
| 2 | TiTAN MB | BK90 | Sy | 2.9 | 3 | 10 | 4 |
| 3 | TiTAN MB | BK110 | Sy | 2.9 | 3 | 10 | 4 |
| 4 | TiTAN MB | BK40 | SySa | 3.8 | 3 | 6 | 5 |
| 5 | TiTAN MB | BK90 | SySa | 3.8 | 3 | 12 | 4 |
| 6 | TiTAN MB | BK110 | SySa | 3.8 | 3 | 13 | 3 |
| 7 | TiTAN MB | BK40 | C | 3.2 | 3 | 6 | 2 |
| 8 | TiTAN MB | BK90 | C | 3.2 | 3 | 9 | 3 |
| 9 | TiTAN MB | BK110 | C | 3.2 | 3 | 10 | 3 |
| 10 | TiTAN MB | BK40 | SySaL-B2 | 5.3 | 3 | 7 | 3 |
| 11 | TiTAN MB | BK90 | SySaL-B2 | 5.3 | 3 | 13 | 2 |
| 12 | TiTAN MB | BK40 | CL-B2 | 5.0 | 3 | 5 | 3 |
| 13 | TiTAN MB | BK90 | CL-B2 | 5.0 | 3 | 11 | 3 |
| 14 | TiTAN MB | BK40 | CT-B2 | 5.0 | 3 | 6 | 2 |
| 15 | TiTAN MB | BK90 | CT-B2 | 5.0 | 3 | 9 | 4 |
| 16 | TiTAN MB | BK90 | SySa | 3.7 | 12 | 7 | 4 |
| 17 | TiTAN MB | BK90 | Sy | 2.9 | 12 | 3 | 4 |
| 18 | TiTAN MB | BK90 | SySaL-B2 | 5.5 | 12 | 10 | 3 |
| 19 | TiTAN MB | BK90 | CL-B2 | 5.3 | 12 | 6 | 4 |
| 20 | TiTAN MB | BK90 | CT-B2 | 5.0 | 12 | 5 | 4 |
| 21 | TiTAN MB | BK90 | C | 3.3 | 12 | 3 | 4 |
| 22 | TiTAN MB | BK40 | Sy | Full Barrel-No Tube | 3 | 10 | 1 |
| 23 | TiTAN MB | BK90 | Sy | Full Barrel-No Tube | 3 | 11 | 3 |
| 24 | TiTAN MB | BK110 | Sy | Full Barrel-No Tube | 3 | 12 | 4 |
| 25 | TiTAN MB | BK40 | SySa | Full Barrel-No Tube | 3 | 8 | 3 |
| 26 | TiTAN MB | BK90 | SySa | Full Barrel-No Tube | 3 | 10 | 4 |
| 27 | TiTAN MB | BK110 | SySa | Full Barrel-No Tube | 3 | 13 | 3 |
| 28 | TiTAN MB | BK40 | SySaL-B2 | Full Barrel-No Tube | 3 | 7 | 3 |
| 29 | TiTAN MB | BK90 | SySaL-B2 | Full Barrel-No Tube | 3 | 12 | 3 |
| 30 | Carbon Fire 10 | EODXP-Medium | Water | Full Barrel-No Tube | 3 | 6 | 3 |
| 31 | Carbon Fire 10 | EODXP-High | Water | Full Barrel-No Tube | 3 | 7 | 4 |
| 32 | Carbon Fire 10 | EODXP-Ultra | Water | Full Barrel-No Tube | 3 | 6 | 5 |
| 33 | TiTAN MB | BK40 | Water | Full Barrel-No Tube | 3 | 6 | 4 |
| 34 | TiTAN MB | BK90 | Water | Full Barrel-No Tube | 3 | 9 | 3 |
| 35 | TiTAN MB | BK110 | Water | Full Barret-No Tube | 3 | 9 | 5 |

TABLE 5

Comparative Penetration of various HEET Mixtures loaded in Plastic Tubes on Laminar 0.5" Plywood Sheets with 3" Spacing using TiTAN MB Disrupter at 12" Stand-off

| Test No. | Disrupter | Cartridge | Projectile Mixture | Projectile Weight (oz.) | Disrupter Stand-Off (in) | Panels Perforated | Panels Fractured | Max Hole Diameter (in) | Max Hole Panel |
|---|---|---|---|---|---|---|---|---|---|
| 1 | TiTAN MB | BK90 | Sy | 3.1 | 12 | 3 | 0 | 3.5 | 2 |
| 2 | TiTAN MB | BK90 | SySa | 3.9 | 12 | 7 | 1 | 3.6 | 2 |
| 3 | TiTAN MB | BK90 | SySaL-B2 | 5.4 | 12 | 6 | 1 | 3.2 | 3 |
| 4 | TiTAN MB | BK90 | C | 3.2 | 12 | 4 | 1 | 4.7 | 1 |
| 5 | TiTAN MB | BK90 | CL-B2 | 5.1 | 12 | 3 | 2 | 4.4 | 1 |
| 6 | TiTAN MB | BK90 | CT-B2 | 5.4 | 12 | 7 | 1 | 3.7 | 1 and 2 |

TABLE 6

Comparative Penetration of various HEET Mixtures loaded in Plastic Tubes on Laminar 0.5" Plywood Sheets with 3" Spacing using Carbon Fire 10 Disrupter

| Test No. | Disrupter | Cartridge | Projectile Mixture | Projectile Weight (oz.) | Disrupter Stand-Off (in) | Panels Perforated | Panels Fractured | Max Hole Diameter (in) | Max Hole Panel |
|---|---|---|---|---|---|---|---|---|---|
| 1 | Carbon Fire 10 | EOD XP-HV | Sy | 2.3 | 3 | 3 | 1 | 3.0 | 2 |
| 2 | Carbon Fire 10 | EOD XP-HV | SySa | 2.9 | 3 | 6 | 1 | 2.5 | 5 |
| 3 | Carbon Fire 10 | EOD XP-HV | SySaL-B2 | 4.4 | 3 | 8 | 1 | 2.9 | 6 |
| 4 | Carbon Fire 10 | EOD XP-HV | C | 2.6 | 3 | 4 | 1 | 5.5 | 3 |
| 5 | Carbon Fire 10 | EOD XP-HV | CT-82 | 4.3 | 3 | 6 | 1 | 4.9 | 3 |
| 6 | Carbon Fire 10 | EOD XP-HV | CL-82 | 4.4 | 3 | 5 | 1 | 4.6 | 4 |
| 7 | Carbon Fire 10 | EOD XP-HV | Sy | 2.4 | 12 | 2 | 1 | 3.4 | 1 |
| 8 | Carbon Fire 10 | EOD XP-HV | SySa | 3.0 | 12 | 2 | 2 | 5.0 | 1 |
| 9 | Carbon Fire 10 | EOD XP-HV | SySaL-B2 | 4.7 | 12 | 7 | 2 | 4.5 | 2 |
| 10 | Carbon Fire 10 | EOD XP-HV | C | 2.5 | 12 | 2 | 1 | 7.0 | 1 |
| 11 | Carbon Fire 10 | EOD XP-HV | CT-B2 | 4.4 | 12 | 5 | 1 | 3.8 | 3 |
| 12 | Carbon Fire 10 | EOD XP-HV | CL-82 | 4.4 | 12 | 4 | 1 | 5.0 | 1 |

TABLE 7

Comparative Penetration of Water Jets on Laminar 0.5" Plywood Sheets with 3" Spacing

| Test No. | Disrupter | Cartridge | Projectile | Projectile Weight (oz.) | Disrupter Stand-Off (in) | Panels Perforated | Panels Fractured | Max Hole Diameter (in) | Max Hole Panel |
|---|---|---|---|---|---|---|---|---|---|
| 1 | TiTAN MB | BK40 | Water | Full Barrel | 3 | 4 | 0 | 2.9 | 3 |
| 2 | TiTAN MB | BK90 | Water | Full Barrel | 3 | 4 | 1 | 3.8 | 3 |
| 3 | TiTAN MB | BK110 | Water | Full Barrel | 3 | 4 | 1 | 4.2 | 3 |
| 4 | TiTAN MB | BK40 | Water | Full Barrel | 12 | 2 | 1 | 4.6 | 1 |
| 5 | TiTAN MB | BK90 | Water | Full Barrel | 12 | 2 | 1 | 4.3 | 1 |
| 6 | TiTAN MB | BK110 | Water | Full Barrel | 12 | 3 | 1 | 5.1 | 1 |
| 7 | Carbon Fire 10 | EOD XP-MV | Water | Full Barrel | 3 | 3 | 1 | 3.4 | 3 |
| 8 | Carbon Fire 10 | EOD XP-HV | Water | Full Barrel | 3 | 3 | 1 | 3.4 | 3 |
| 9 | Carbon Fire 10 | EOD XP-MV | Water | Full Barrel | 12 | 1 | 0 | 2.7 | 1 |
| 10 | Carbon Fire 10 | EOD XP-HV | Water | Full Barrel | 12 | 2 | 0 | NA | NA |
| 11 | Carbon Fire 10 | EOD XP-UV | Water | Full Barrel | 12 | 2 | 1 | 5.3 | 1 |

TABLE 8

Comparative Penetration of Various Projectiles on Laminar 0.5" Plywood Sheets with 3" Spacing using PAN Disupter

| Test No. | Disrupter | Cartridge | Projectile | Projectile Weight (oz) | Disrupter Stand-Off (in) | Panels Perforated | Panels Fractured | Max Hole Diameter (in) | Max Hole Panel |
|---|---|---|---|---|---|---|---|---|---|
| 1 | PAN | BK40 | Water (140 ml) | 4.9 | 6 | 8 | 1 | 2.5 | 1 |
| 2 | PAN | BK90 | Water (140 ml) | 4.9 | 6 | 10 | 0 | 3.0 | 8 |
| 3 | PAN | BK110 | Water (140 ml) | 4.9 | 6 | 10 | 1 | 4.0 | 9 |
| 4 | PAN | BK40 | Sy (140 ml) | 6.8 | 6 | 16 | 0 | 2.4 | 6 |
| 5 | PAN | BK90 | SyL-B1 | NA | 6 | 16 | 0 | 3.5 | 1 |

We claim:

1. A projectile system for use in a propellant driven disrupter, comprising:

the propellant driven disrupter comprising:

a barrel having a barrel lumen;

a propellant-filled cartridge;

a projectile in the barrel lumen comprising a highly efficient energy transfer (HEET) fluid having a HEET fluid distal end and a HEET fluid proximal end;

a cap positioned in the barrel to fluidically seal the HEET fluid within the barrel lumen at the HEET fluid distal end;

wherein:

the barrel has a longitudinal length ($L_B$) and the projectile has a longitudinal length $L_p$, and $0.1 \leq Lp/L_B \leq 1$;

the HEET fluid is configured during use to form a fluid jet having a jet length after exiting the barrel and before a target impact, the HEET fluid is selected from the group consisting of at least one of water, oil, syrup, ionic solutions, alcohol, a liquid polymer, a pre-polymer, an elastomer-containing liquid, a mechanophore, and a clay, having an effective density of between 0.5 g/mL to 15 g/mL at 20° C.;

the projectile is a physically separate component from the propellant-filled cartridge; and wherein the projectile includes a plurality of HEET fluid zones, and wherein the HEET fluid comprises a plurality of unique HEET fluid compositions with a unique HEET fluid composition contained in each fluid zone.

2. The projectile system of claim 1, wherein the HEET fluid has an effective viscosity selected from a range of 1 cP to 100,000 cP at 20° C.

3. The projectile system of claim 1, wherein the HEET fluid has a surface tension selected from a range of 70 mN/m to 510 mN/m at 20° C.

4. The projectile system of claim 1, wherein the projectile further comprises a friction reducing liner having a lumen extending between a proximal end and a distal end, the lumen at least partially filled by the HEET fluid, and wherein the friction reducing liner comprises a material selected from at least one of polymer, plastic, paper, wax, and polytetrafluoroethylene, and physically separates the HEET fluid from an inner surface of the barrel.

5. The projectile system of claim 1, wherein the HEET fluid comprises a plurality of solid particles, and wherein the plurality of solid particles are positioned at the HEET fluid proximal end to form a HEET density gradient, with a highest effective density at the HEET fluid proximal end.

6. The projectile system of claim 1, wherein the HEET fluid comprises solid particles immersed in a fluid.

7. A projectile system for use in a propellant driven disrupter, comprising:

the propellant driven disrupter comprising:

a barrel;

a propellant-filled cartridge; and a projectile comprising a highly efficient energy transfer (HEET) fluid;

wherein:

the barrel has a longitudinal length ($L_B$) and the projectile has a longitudinal length $L_P$, and $0.1 \leq L_P/L_B \leq 1$:

the HEET fluid is configured during use to form a fluid jet having a let length after exiting the barrel and before a target impact, and the HEET fluid is selected from the group consisting of at least one of water, oil, syrup, ionic solutions, alcohol, a liquid polymer, a pre-polymer, an elastomer-containing liquid, a mechanophore, and a clay, having an effective density of between 0.5 g/mL to 15 g/mL at 20° C., wherein the projectile further comprises a friction reducing liner forming a container lumen filled by the HEET fluid, wherein the container lumen includes a plurality of HEET fluid zones, and wherein the HEET fluid comprises a plurality of unique HEET fluid compositions with a unique HEET fluid composition contained in each fluid zone.

8. The projectile system of claim 7, further comprising a membrane separating adjacent fluid zones, wherein the membrane is configured to prevent migration of HEET fluid and any constituent thereof between adjacent fluid zones.

9. The projectile system of claim 6, further comprising a proximal HEET fluid positioned in a proximal HEET fluid zone; and a distal HEET fluid positioned in a distal HEET fluid zone, wherein the proximal HEET fluid has a higher effective density and a higher effective viscosity than the distal HEET fluid, and wherein the proximal HEET fluid comprises the solid particles, which are one of suspended and dispersed in a fluid.

10. The projectile system of claim 6, further comprising a proximal HEET fluid positioned in a proximal HEET fluid zone; and a distal HEET fluid positioned in a distal HEET fluid zone, wherein the proximal HEET fluid has a higher effective density and a higher effective viscosity than the distal HEET fluid, wherein the proximal HEET fluid comprises solid particles, which are one of suspended and dispersed in a fluid, wherein the distal HEET fluid comprises at least one of water, syrup, liquid polymer, pre-polymer, elastomer-containing liquid, alcohol, oil, ionic solution, mechanophore, and clay, and wherein the solid particles of the proximal HEET fluid are selected from the group consisting of at least one of clay, steel shot, lead shot, plastic beads, sand, metallic microparticles, garnet microparticles, ceramic powder, wood dust, and plastic dust.

11. The projectile system of claim 7, wherein the HEET fluid is configured, so that when propelled in the barrel the HEET fluid has a Reynolds number in the barrel of between 75 and 4000.

12. The projectile system of claim 6, wherein the solid particles have a distribution in the fluid that is substantially uniform.

13. The projectile system of claim 6, wherein the solid particles have a distribution in the fluid that is not uniform.

14. The projectile system of claim 6, wherein the HEET fluid is contained within a friction-reducing container.

15. A method of making a projectile for use in a propellant driven disrupter, comprising:

providing a friction-reducing container being shaped for fitting within a barrel of the propellant driven disrupter;

filling the container with a HEET fluid;

sealing the friction reducing container containing the HEET fluid;

filling a proximal end of the friction-reducing container with a proximal HEET fluid;

filling a distal end of the friction-reducing container with a distal HEET fluid, wherein the proximal HEET fluid and distal HEET fluid have at least one fluid property that is different from each other, and wherein said at least one fluid property is selected from at least one of effective density, effective viscosity, a fluid composition type, and presence of particulates in the fluid, thereby reducing a reverse velocity gradient of a fluid let exiting the barrel after expulsion to increase fluid jet integrity.

16. The method of claim 15, further comprising selecting a HEET fluid based on at least one fluid parameter for achieving at least one target disruption parameter, wherein said at least one fluid parameter selected is from at least one of effective viscosity;

effective density;

surface tension;

presence of solid particles in the HEET fluid;

absence of solid particles in the HEET fluid;

average size of the solid particles in the HEET fluid;

Reynolds number of propelled HEET fluid in a barrel of the propellant driven disrupter;

density gradient;

viscosity gradient; and a number of unique HEET fluids positioned in the container lumen, and wherein said at least one target disruption parameter is selected from at least one of fluid jet duration;

fluid jet velocity;

fluid jet length at impact;

momentum and energy transfer to target;

volumetric disruption; and penetration depth.

17. The method of claim 16, wherein said at least one fluid parameter further comprises average size of solid particles having a magnitude selected to achieve one or more desired fluid jet parameters upon HEET ejection from the barrel of the propellant driven disrupter.

* * * * *